US009070372B2

(12) United States Patent
Endo et al.

(10) Patent No.: US 9,070,372 B2
(45) Date of Patent: Jun. 30, 2015

(54) APPARATUS AND METHOD FOR VOICE PROCESSING AND TELEPHONE APPARATUS

(75) Inventors: Kaori Endo, Kawasaki (JP); Takeshi Otani, Kawasaki (JP); Hitoshi Sasaki, Kawasaki (JP); Mitsuyoshi Matsubara, Fukuoka (JP); Rika Nishiike, Kawasaki (JP); Kaoru Chujo, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 472 days.

(21) Appl. No.: 13/072,992

(22) Filed: Mar. 28, 2011

(65) Prior Publication Data

US 2012/0016669 A1 Jan. 19, 2012

(30) Foreign Application Priority Data

Jul. 15, 2010 (JP) ..... 2010-160346

(51) Int. Cl.

| | |
|---|---|
| ***G10L 19/00*** | (2013.01) |
| ***G10L 21/00*** | (2013.01) |
| ***G10L 21/02*** | (2013.01) |
| ***G10L 21/038*** | (2013.01) |

(Continued)

(52) U.S. Cl.

CPC ..... *G10L 21/038* (2013.01); *G10L 21/0232* (2013.01); *G10L 21/0208* (2013.01); *G10L 21/02* (2013.01)

(58) Field of Classification Search

CPC . G10L 21/0208; G10L 21/02; G10L 21/0232; G10L 19/0204; G10L 21/038

USPC ..... 704/500

See application file for complete search history.

(56) References Cited

U.S. PATENT DOCUMENTS 5,907,823 A * 5/1999 Sjoberg et al. ..... 704/225
6,038,532 A 3/2000 Kane et al.

(Continued)

FOREIGN PATENT DOCUMENTS

JP 9-090992 A 4/1997
JP 2830276 B2 12/1998

(Continued)

OTHER PUBLICATIONS

European Office Action dated Aug. 27, 2012, issued in corresponding European Patent Application No. 11 160 750.3-2555 (6 pages).

(Continued)

*Primary Examiner* — Matthew Baker

(74) *Attorney, Agent, or Firm* — Westerman, Hattori, Daniels & Adrian, LLP

(57) ABSTRACT

A voice processing apparatus includes a voice signal acquiring unit that acquires a voice signal converted to plural frequency bands from an input signal having a narrowed band; an expanding unit that generates based on a narrowband component of the voice signal acquired by the voice signal acquiring unit, an expansion band component expanding the band of the voice signal; a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit.

7 Claims, 23 Drawing Sheets

(51) Int. Cl.
*G10L 21/0232* (2013.01)
*G10L 21/0208* (2013.01)

(56) References Cited

U.S. PATENT DOCUMENTS

| | | | | |
|---|---|---|---|---|
| 7,461,003 | B1 * | 12/2008 | Tanrikulu | 704/500 |
| 7,788,105 | B2 * | 8/2010 | Miseki | 704/500 |
| 7,813,931 | B2 * | 10/2010 | Hetherington et al. | 704/500 |
| 8,010,353 | B2 * | 8/2011 | Kawashima et al. | 704/225 |
| 8,095,374 | B2 * | 1/2012 | Tanrikulu | 704/500 |
| 8,135,728 | B2 * | 3/2012 | Yih et al. | 707/765 |
| 8,140,324 | B2 * | 3/2012 | Vos et al. | 704/225 |
| 8,321,215 | B2 * | 11/2012 | Alves et al. | 704/225 |
| 8,332,228 | B2 * | 12/2012 | Vos et al. | 704/500 |
| 8,364,494 | B2 * | 1/2013 | Vos et al. | 704/500 |
| 2002/0172350 | A1 * | 11/2002 | Edwards et al. | 379/392.01 |
| 2004/0136447 | A1 * | 7/2004 | LeBlanc | 375/222 |
| 2004/0138876 | A1 * | 7/2004 | Kallio et al. | 704/209 |
| 2005/0143988 | A1 | 6/2005 | Endo et al. | |
| 2005/0267741 | A1 * | 12/2005 | Laaksonen et al. | 704/209 |
| 2007/0150269 | A1 | 6/2007 | Nongpiur et al. | |
| 2009/0144262 | A1 * | 6/2009 | White et al. | 707/5 |
| 2009/0245527 | A1 * | 10/2009 | Kumar et al. | 381/66 |
| 2009/0281800 | A1 * | 11/2009 | LeBlanc et al. | 704/224 |
| 2009/0281801 | A1 * | 11/2009 | Thyssen et al. | 704/225 |
| 2009/0281802 | A1 * | 11/2009 | Thyssen et al. | 704/226 |
| 2009/0281803 | A1 * | 11/2009 | Chen et al. | 704/226 |
| 2009/0281805 | A1 * | 11/2009 | LeBlanc et al. | 704/233 |
| 2009/0287496 | A1 * | 11/2009 | Thyssen et al. | 704/500 |
| 2010/0004927 | A1 | 1/2010 | Endo et al. | |
| 2010/0246849 | A1 * | 9/2010 | Sudo et al. | 381/94.1 |
| 2011/0081026 | A1 * | 4/2011 | Ramakrishnan et al. | 381/94.3 |
| 2011/0125491 | A1 * | 5/2011 | Alves et al. | 704/207 |
| 2011/0125492 | A1 * | 5/2011 | Alves et al. | 704/207 |
| 2011/0125494 | A1 * | 5/2011 | Alves et al. | 704/226 |
| 2012/0016669 | A1 * | 1/2012 | Endo et al. | 704/205 |
| 2012/0213385 | A1 | 8/2012 | Liljeryd et al. | |

FOREIGN PATENT DOCUMENTS

| | | | |
|---|---|---|---|
| JP | 3301473 | B2 | 7/2002 |
| JP | 2002-536679 | A | 10/2002 |
| JP | 2003-70097 | A | 3/2003 |
| JP | 2003-255973 | A | 9/2003 |
| JP | 2005-101917 | A | 4/2005 |
| JP | 2005-165021 | A | 6/2005 |
| JP | 2007-171954 | A | 7/2007 |
| JP | 2007-324675 | A | 12/2007 |
| JP | 2009-134260 | A | 6/2009 |
| JP | 2010-14914 | A | 1/2010 |
| WO | 2009/099835 | A1 | 8/2009 |

OTHER PUBLICATIONS

European Search Report dated Nov. 29, 2011, issued in corresponding European Patent Application No. 11 160 750.3.

Japanese Office Action dated Nov. 26, 2013, issued in corresponding Japanes Application No. 2010-160346 w/ Partial English Translation. (4 pages).

* cited by examiner

FIG.36

360

| Ni | Ai |
|---|---|
| ≤0.0 | 0 |
| 0.1 | 0.2 |
| 0.2 | 0.4 |
| 0.3 | 0.6 |
| 0.4 | 0.8 |
| 0.5 | 1 |
| 0.6 | 1.2 |
| 0.7 | 1.4 |
| 0.8 | 1.6 |
| 0.9 | 1.8 |
| ≥1.0 | 2 |

APPARATUS AND METHOD FOR VOICE PROCESSING AND TELEPHONE APPARATUS

CROSS REFERENCE TO RELATED APPLICATIONS

This application is based upon and claims the benefit of priority of the prior Japanese Patent Application No. 2010-160346, filed on Jul. 15, 2010, the entire contents of which are incorporated herein by reference.

FIELD

The embodiments discussed herein are related to voice signal processing.

BACKGROUND

For example, with mobile telephones and Voice over Internet Protocol (VoIP), a voice signal is transmitted after the voice signal is converted to a narrowband (e.g., 300 [Hz] to 3400 [Hz]) and consequently, the voice signal deteriorates (e.g. generation of a muffled-voice sound). As a countermeasure, a technology is conventionally known of copying a frequency component of the narrowband voice signal to an expansion band, thereby pseudo converting the signal to a wideband signal. For example, a method is disclosed of generating a high band signal by copying a component of an input signal to a high band and obtaining a low band signal by full wave rectification of the input signal (see, e.g., Japanese Patent Laid-Open Publication No. H9-90992).

The conventional technology described above, however, cannot sufficiently obtain the effect of the band expansion, depending on the noise included in a received voice signal or the noise on the reproducing side. Further, voice quality could further deteriorate as a side effect of the band expansion. For this reason, there is a problem in that the conventional technology described above is incapable of sufficiently improving the quality of the voice to be reproduced.

SUMMARY

According to an aspect of an embodiment, a voice processing apparatus includes a voice signal acquiring unit that acquires a voice signal converted to plural frequency bands from an input signal having a narrowed band; an expanding unit that generates based on a narrowband component of the voice signal acquired by the voice signal acquiring unit, an expansion band component expanding the band of the voice signal; a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 36 depicts one example of a correspondence table.

DESCRIPTION OF EMBODIMENTS

Preferred embodiments of the present invention will be explained with reference to the accompanying drawings.

Figure 1:
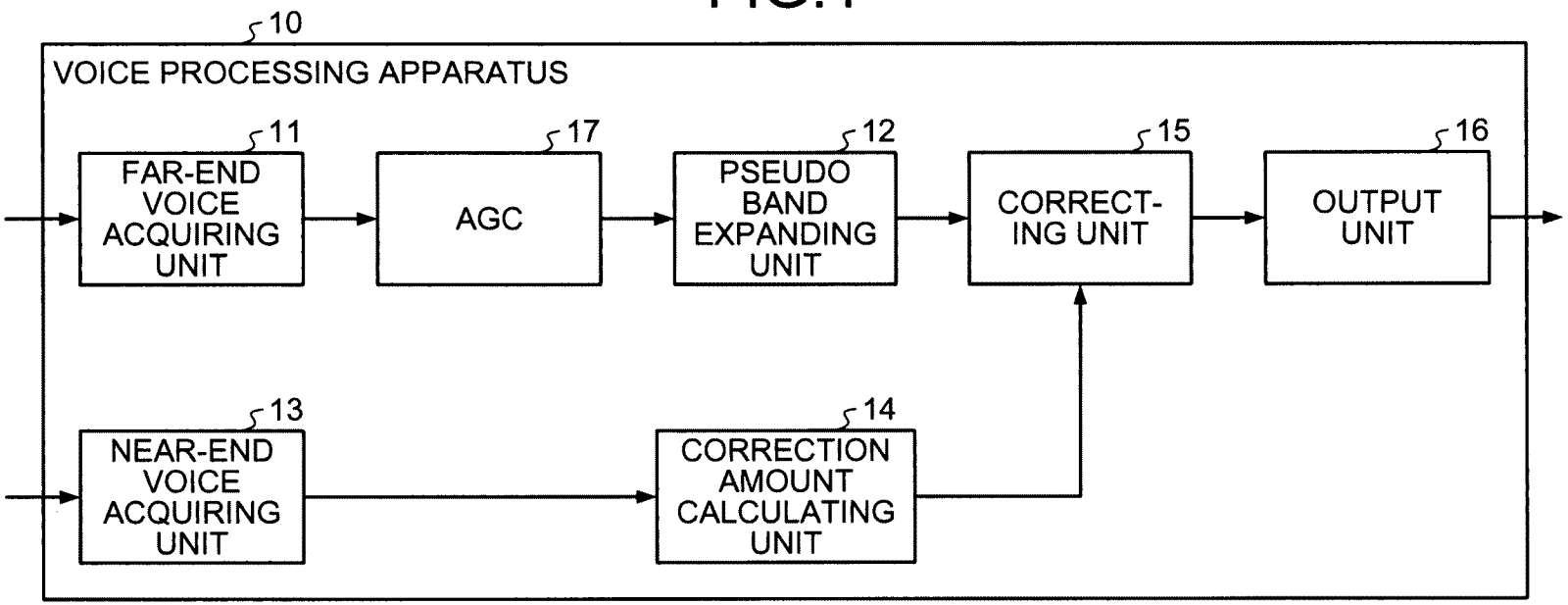
FIG. 1 is a block diagram of a voice processing apparatus according to a first embodiment.

FIG. 1 is a block diagram of a voice processing apparatus according to a first embodiment. As depicted in FIG. 1, a voice processing apparatus 10 according to the first embodiment is equipped with a far-end voice acquiring unit 11, a pseudo band expanding unit 12, a near-end voice acquiring unit 13, a correction amount calculating unit 14, a correcting unit 15, an output unit 16, and an automatic gain controller (AGC) 17.

The far-end voice acquiring unit 11 and the near-end voice acquiring unit 13 are each a voice signal acquiring unit that acquires a voice signal converted to plural frequency bands from an input signal whose band has been narrowed. The far-end voice acquiring unit 11 and the near-end voice acquiring unit 13 may be implemented, for example, by a Fast Fourier Transform (FFT) unit, respectively. The far-end voice acquiring unit 11 and the near-end voice acquiring unit 13 acquire voice signals, for example, in 20-msec units.

The far-end voice acquiring unit 11 is a first acquiring unit that acquires a far-end voice signal (first voice signal). The far-end voice signal is a voice signal received by way of a network. For example, the far-end voice acquiring unit 11 acquires the far-end voice signal from a receiving circuit disposed upstream from the voice processing apparatus 10. The far-end voice acquiring unit 11 outputs the acquired far-end voice signal to the pseudo band expanding unit 12.

The pseudo band expanding unit 12 is an expanding unit that pseudo expands the band of the far-end voice signal (narrowband component) output from the far-end voice acquiring unit 11, the band being expanded by an expansion band component generated based on the far-end voice signal output from the far-end voice acquiring unit 11. The pseudo expansion of the band will be described later. The pseudo band expanding unit 12 outputs to the correcting unit 15, the far-end voice signal whose band has been expanded.

The near-end voice acquiring unit 13 is a second acquiring unit that acquires a near-end voice signal (second voice signal). The near-end voice signal is a voice signal indicative of a voice near a reproducing device that reproduces the far-end voice signal processed by the voice processing apparatus 10. For example, the near-end voice acquiring unit 13 acquires the near-end voice signal from a microphone disposed near the reproducing device that reproduces the far-end voice signal. The near-end voice signal is, for example, a signal whose band has been narrowed. The near-end voice acquiring unit 13 outputs the acquired near-end voice signal to the correction amount calculating unit 14.

The correction amount calculating unit 14 is a calculating unit that calculates a correction amount based on a noise component (hereinafter, near-end noise component) included in the near-end voice signal output from the near-end voice acquiring unit 13. For example, the correction amount calculating unit 14 extracts the near-end noise component from the near-end voice signal. Various methods are available for the extraction of the near-end noise component. For example, the correction amount calculating unit 14 extracts the near-end noise component from the near-end voice signal through a method of obtaining a signal of frequency domain of the noise by a noise prediction unit (see, e.g., Japanese Patent No. 2830276). For example, a silent interval included in the near-end voice signal is extracted and the noise component can be estimated from the extracted silent interval.

The correction amount calculating unit 14 calculates the correction amount based on the magnitude of the extracted near-end noise component. For example, the greater the extracted near-end noise component is, the greater the correction amount is that the correction amount calculating unit 14 calculates. The correction amount calculating unit 14 outputs the calculated correction amount to the correcting unit 15.

The correcting unit 15 is a correcting unit that corrects, by the correction amount output from the correction amount calculating unit 14, the power of the expansion band component of the far-end voice signal output from the pseudo band expanding unit 12. The correcting unit 14 outputs to the output unit 16, the far-end voice signal whose expansion band component has been corrected for power.

The output unit 16 is an output unit that transforms the far-end voice signal output from the correcting unit 15 to a time band and outputs the transformed far-end voice signal to the reproducing device. The output unit 16 may be implemented, for example, by an Inverse Fast Fourier Transform (IFFT) unit. Consequently, the far-end voice signal whose band has been pseudo expanded is reproduced by the reproducing device.

The AGC 17 may be disposed between the far-end voice acquiring unit 11 and the pseudo band expanding unit 12. The AGC 17 performs constant-gain control of the far-end voice signal output from the far-end voice acquiring unit 11 to the pseudo band expanding unit 12. The AGC 17 may be disposed between the correcting unit 15 and the output unit 16 or upstream from the far-end voice acquiring unit 11 or downstream from the output unit 16. The voice processing apparatus 10 may be configured to exclude the AGC 17.

Figure 2:
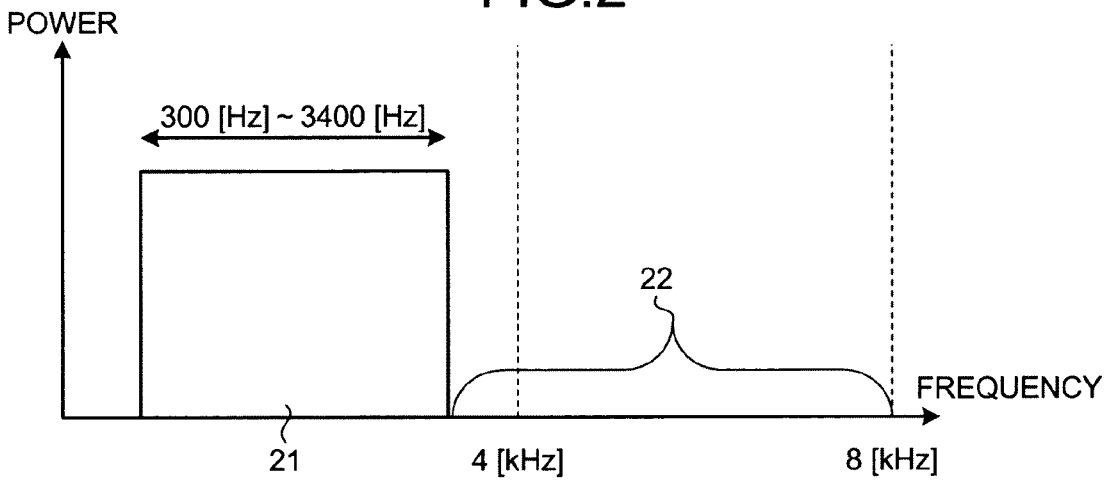
FIG. 2 depicts one example of a far-end voice signal acquired by a far-end voice acquiring unit.

FIG. 2 depicts one example of the far-end voice signal acquired by the far-end voice acquiring unit. In FIG. 2, the horizontal axis represents frequency, the vertical axis representing power. A band component 21 denotes one example of the far-end voice signal acquired by the far-end voice acquiring unit 11. The band of the band component 21 is, for example, 300 [Hz] to 3400 [Hz]. The far-end voice signal received by way of the network has a band that is narrower than that of the original voice signal. For example, a band 22 exceeding 3400 [Hz] included in the original voice signal is not included in the band component 21.

Figure 3:
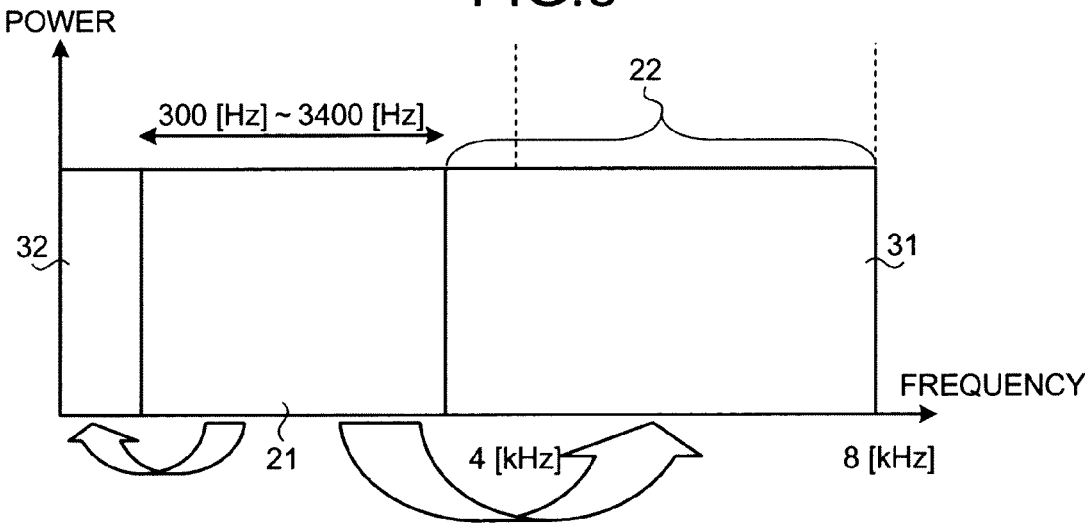
FIG. 3 depicts one example of the far-end voice signal whose band has been expanded by a pseudo band expanding unit.

FIG. 3 depicts one example of the far-end voice signal whose band has been expanded by the pseudo band expanding unit. In FIG. 3, the horizontal axis represents frequency and the vertical axis represents power. In FIG. 3, portions identical to those depicted in FIG. 2 are given the same reference numerals used in FIG. 2 and description thereof is omitted.

The pseudo band expanding unit 12 generates an expansion band component 31 on a higher frequency side of the band 21, for example, by copying the band component 21 to the band 22. The pseudo band expanding unit 12 generates an expansion band component 32 on a lower frequency side of the band 21, for example, by distorting the far-end voice signal by waveform processing (e.g., full-wave rectification). The pseudo band expanding unit 12 outputs the band component 21 and the expansion band components 31 and 32 as the far-end voice signal whose band has been expanded.

Figure 4:
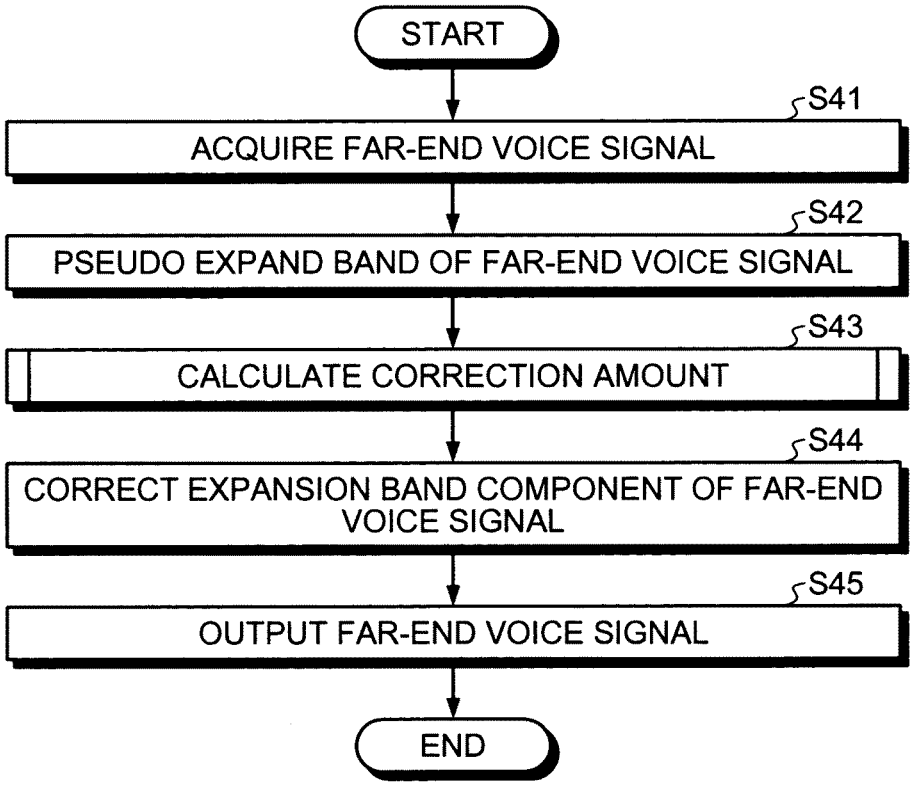
FIG. 4 is a flowchart of one example of operation of the voice processing apparatus.

FIG. 4 is a flowchart of one example of operation of the voice processing apparatus. As depicted in FIG. 4, firstly, the far-end voice acquiring unit 11 acquires a far-end voice signal (step S41). Then, the pseudo band expanding unit 12 pseudo expands the band of the far-end voice signal acquired at step S41 (step S42). The correction amount calculating unit 14 calculates a correction amount for an expansion band component of the far-end voice signal (step S43).

The correcting unit 15 corrects, by the correction amount calculated at step S43, the power of the expansion band component of the far-end voice signal whose band has been expanded at step S42 (step S44). The output unit 16 outputs to the reproducing device, the far-end voice signal corrected at step S44 (step S45), ending a sequence of operations.

Figure 5:
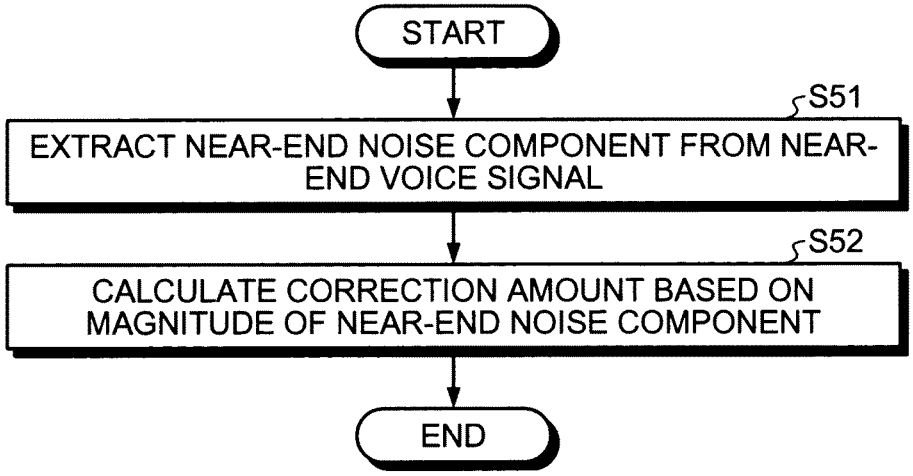
FIG. 5 is a flowchart of one example of an operation of calculating a correction amount according to the first embodiment.

FIG. 5 is a flowchart of one example of an operation of calculating the correction amount according to the first embodiment. The correction amount calculating unit 14 calculates the correction amount, for example, by the following steps. The correction amount calculating unit 14 firstly extracts a near-end noise component from the near-end voice signal (step S51). The correction amount calculating unit 14 then calculates the correction amount based on the magnitude of the near-end noise component extracted at step S51 (step S52), ending a sequence of operations.

Figure 6:
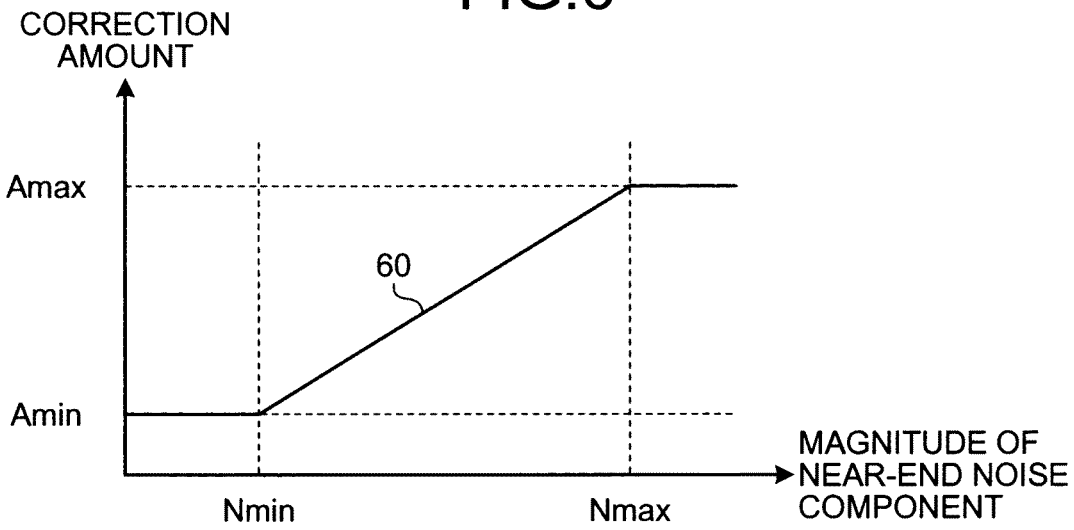
FIG. 6 is a graph of a relationship of a near-end noise component and the correction amount.

FIG. 6 is a graph of a relationship of the near-end noise component and the correction amount. In FIG. 6, the horizontal axis represents the magnitude of the near-end noise component and the vertical axis represents the correction amount calculated by the correction amount calculating unit 14. Nmin along the horizontal axis is a minimum value (e.g., −50 [dB]) of the near-end noise component. Nmax along the horizontal axis is a maximum value (e.g., 50 [dB]) of the near-end noise component. Amin along the vertical axis is a minimum value (e.g., 0.0) of the correction amount. Amax along the vertical axis is a maximum value (e.g., 2.0) of the correction amount.

Index is given as i that corresponds to each frequency of the voice signal acquired by the far-end voice acquiring unit 11 and the near-end voice acquiring unit 13. If the number of divisions of the frequency of the FFT in the far-end voice acquiring unit 11 and the near-end voice acquiring unit 13 is given as FN, then i assumes a value within the range of 0 to FN−1. For example, if the far-end voice acquiring unit 11 and the near-end voice acquiring unit 13 divide the band of 0 to 8 [kHz] by the band of 31.25 [Hz], then, FN is 256.

The index of the frequency of the expansion band component is given as i=FB to FE, where FB is a minimum value of the index of the frequency of the expansion band component and FE is a maximum value of the index of the frequency of the expansion band component (FE=FN−1). With respect to the correction amount of the frequency i=FB to FE, the correction amount calculating unit 14 calculates a correction amount Ai, for example, according to equation (1). Ni is the magnitude of the near-end noise component of the frequency i.

$$Ai = Amin + \frac{Amax - Amin}{Nmax - Nmin}(Ni - Nmin) \quad (1)$$

By calculating the correction amount according to equation (1), the relationship of the near-end noise component and the correction amount is a relationship 60 depicted in FIG. 6. Thus, the correction amount calculating unit 14 calculates a greater correction amount, the greater the near-end noise component is. The correction amount calculating unit 14 determines the correction amount of the frequency i (0 to FB−1) of the narrowband component of the far-end voice signal as Ai=1.0.

When the noise near the reproducing device that reproduces the far-end voice signal is great, a masking amount of the expansion band component becomes great and the effect of the band expansion of the far-end voice signal becomes difficult to perceive by a user. To cope with this, a correction amount is calculated that makes the power of the expansion band component greater, the greater the near-end noise component is so that when the near-end noise is great, the power of the expansion band component can be made great and the effect of the band expansion can be easily perceived by the user. Consequently, the quality can be enhanced of the voice to be reproduced based on the far-end voice signal.

The correcting unit 15 corrects the power of the expansion band component of the far-end voice signal, for example, according to equation (2). Si is a power spectrum of the frequency i in the far-end voice signal output from the pseudo band expanding unit 12. Si' is the power spectrum of the frequency i in the expansion band after the correction by the correcting unit 15.

$$Si' = Ai \times Si \quad (2)$$

Since the correction amount is Ai=1.0 for the frequency i (0 to FB−1) of the narrowband component of the far-end voice signal, Si' becomes equal to Si and correction is not made with respect to the frequency i (0 to FB−1), enabling the far-end voice signal to be obtained whose expansion band component (i=FB to FE) has been corrected for power. Thus, for each frequency i, the correcting unit 15 corrects the power of the expansion band component of the far-end voice signal, for example, by multiplying the power of the expansion band component of the far-end voice signal by the correction amount.

Figure 7:
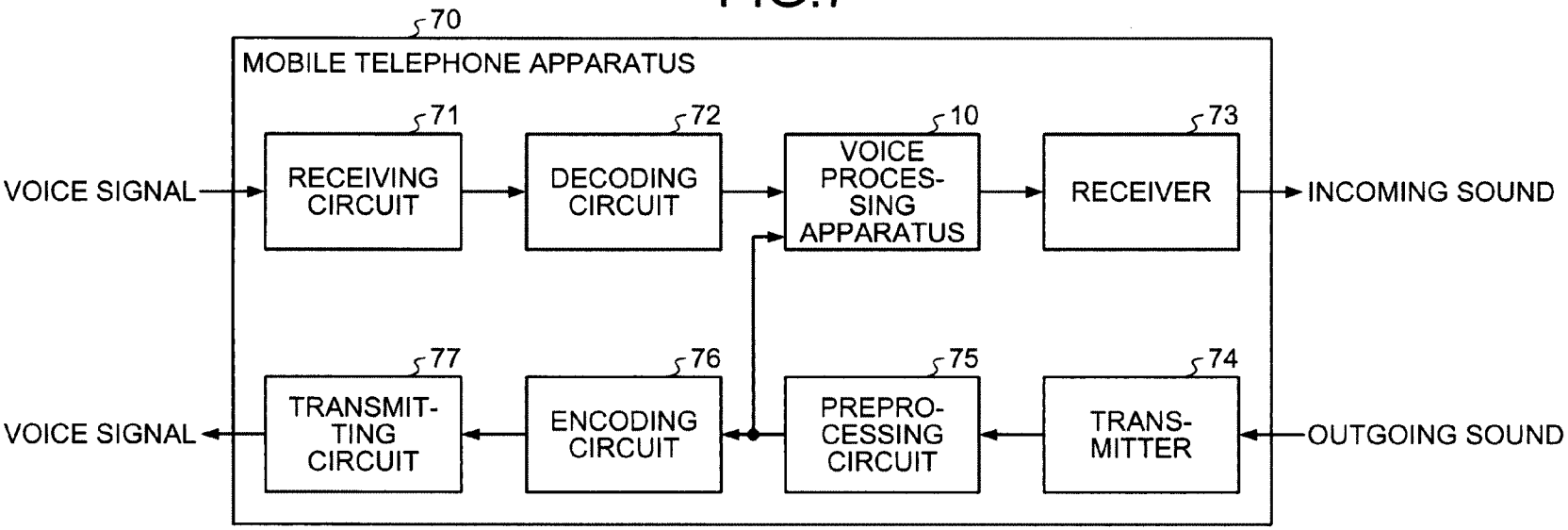
FIG. 7 is a block diagram of one example of a mobile telephone apparatus to which the voice processing apparatus is applied.

FIG. 7 is a block diagram of one example of a mobile telephone apparatus to which the voice processing apparatus is applied. As depicted in FIG. 7, a mobile telephone apparatus 70 is equipped with a receiving circuit 71, a decoding circuit 72, the voice processing apparatus 10, a receiver 73, a transmitter 74, a preprocessing circuit 75, an encoding circuit 76, and a transmitting circuit 77.

The receiving circuit 71, for example, receives a voice signal wirelessly transmitted from a base station. The receiving circuit 71 outputs the received voice signal to the decoding circuit 72. The decoding circuit 72 decodes the voice signal output from the receiving circuit 71. The decoding performed by the decoding circuit 72 includes, for example, forward error correction (FEC). The decoding circuit 72 outputs the decoded voice signal to the voice processing apparatus 10. The voice signal output from the decoding circuit 72 to the voice processing apparatus 10 is the far-end voice signal received by way of the network.

The voice processing apparatus 10 pseudo expands the band of the far-end voice signal output from the decoding circuit 72 and outputs the signal to the receiver 73. For example, the far-end voice acquiring unit 11 of the voice processing apparatus 10 acquires the far-end voice signal output from the decoding circuit 72. The output unit 16 of the voice processing apparatus 10 outputs to the receiver 73, the far-end voice signal whose band has been expanded.

Though not depicted, for example, an analog converter is disposed between the voice processing apparatus 10 and the receiver 73 and the digital far-end voice signal to be output from the voice processing apparatus 10 to the receiver 73 is converted to an analog signal. The receiver 73 is the reproducing device that reproduces the far-end voice signal output from the output unit 16 of the voice processing apparatus 10 as incoming sound.

The transmitter 74 converts outgoing sound to a voice signal and outputs the voice signal to the preprocessing circuit 75. The preprocessing circuit 75 samples the voice signal output from the transmitter 74 to convert the voice signal to a digital signal. The preprocessing circuit 75 outputs the digitally converted voice signal to the voice processing apparatus 10 and the encoding circuit 76.

The voice signal to be output from the preprocessing circuit 75 is the near-end voice signal indicative of the voice near the reproducing device (receiver) that reproduces the far-end voice signal. The near-end voice acquiring unit 13 of the voice processing apparatus 10 acquires the near-end voice signal output from the preprocessing circuit 75. The encoding circuit 76 encodes the voice signal output from the preprocessing circuit 75. The encoding circuit 76 outputs the encoded voice signal to the transmitting circuit 77. The transmitting circuit 77 wirelessly transmits the voice signal output from the encoding circuit 76 to, for example, the base station.

While a configuration has been described of applying the voice processing apparatus 10 to the mobile telephone apparatus 70, the application of the voice processing apparatus 10 is not limited to the mobile telephone apparatus 70. For example, the voice processing apparatus 10 is further applicable to a fixed telephone apparatus, etc. The voice processing apparatus 10 is further applicable to a voice signal receiving device, etc., that do not have a function of transmitting a voice signal. While the configuration has been described to have the voice signal output from the preprocessing circuit 75 be acquired by the voice processing apparatus 10 as the near-end voice signal, the configuration may be such that a voice signal obtained by a microphone, etc., separately disposed near the receiver 73 is acquired by the voice processing apparatus 10 as the near-end voice signal.

Figure 8:
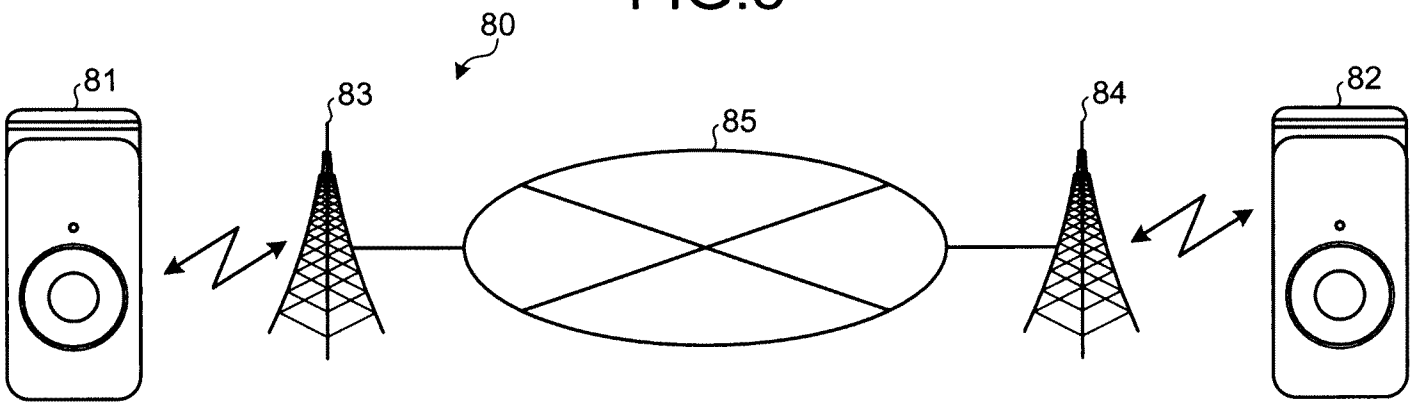
FIG. 8 depicts one example of a communication system to which the mobile telephone apparatus is applied.

FIG. 8 depicts one example of a communication system to which the mobile telephone apparatus is applied. As depicted in FIG. 8, a communication system 80 includes mobile telephone apparatuses 81 and 82, base stations 83 and 84, and a network 85. For example, the mobile telephone apparatus 70 depicted in FIG. 7 is applicable to each of the mobile telephone apparatuses 81 and 82. The mobile telephone apparatus 81 performs the wireless communication with the base station 83. The mobile telephone apparatus 82 performs the wireless communication with the base station 84.

The base stations 83 and 84 perform wired communication with each other by way of the network 85. For example, the mobile telephone apparatus 82 receives, as the far-end voice signal, the voice signal transmitted from the mobile telephone apparatus 81 by way of the base station 83, the network 85, and the base station 84. The mobile telephone apparatus 82 acquires, as the near-end voice signal, the voice signal indicative of the voice near the mobile telephone apparatus 82.

Thus, the voice processing apparatus 10 according to the first embodiment is capable of adjusting the balance of the effect and the side-effect of the band expansion by correcting the power of the expansion band component of the far-end voice signal by the correction amount that is based on the noise component included in the near-end voice signal. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

Figure 9:
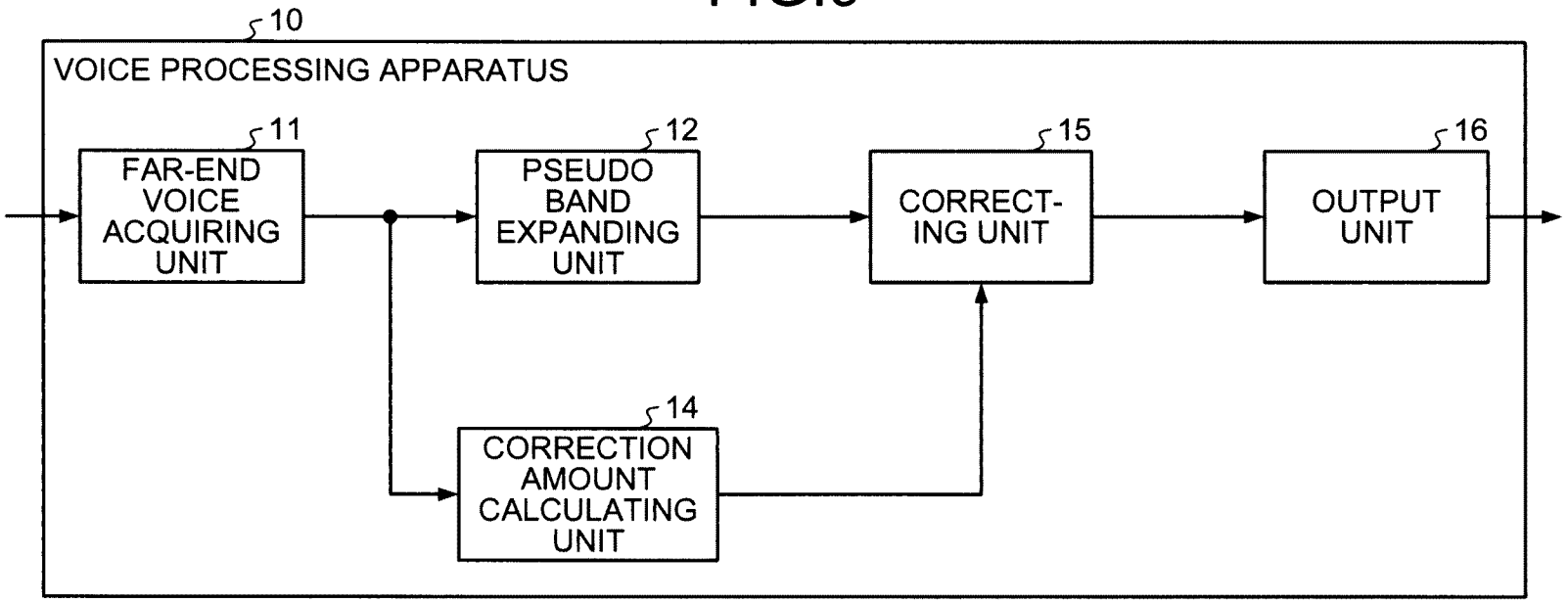
FIG. 9 is a block diagram of the voice processing apparatus according to a second embodiment.

FIG. 9 is a block diagram of the voice processing apparatus according to a second embodiment. In FIG. 9, components identical to those depicted in FIG. 1 are given the same reference numerals used in FIG. 1 and description thereof is omitted. As depicted in FIG. 9, the voice processing apparatus 10 according to the second embodiment is equipped with the far-end voice acquiring unit 11, the pseudo band expanding unit 12, the correction amount calculating unit 14, the correcting unit 15, and the output unit 16. In the second embodiment, the near-end voice acquiring unit 13 depicted in FIG. 1 may be omitted.

The far-end voice acquiring unit 11 outputs the acquired far-end voice signal to the pseudo band expanding unit 12 and the correction amount calculating unit 14. The correction amount calculating unit 14 calculates the correction amount, based on the noise component (hereinafter, far-end noise component) included in the far-end voice signal output from the far-end voice acquiring unit 11. For example, the correction amount calculating unit 14 extracts the far-end noise component from the far-end voice signal. Various methods are available for the extraction of the far-end noise component.

For example, the correction amount calculating unit 14 extracts the far-end noise component from the far-end voice signal through the method of obtaining the signal of the frequency domain of the noise by the noise prediction unit (see, e.g., Japanese Patent No. 2830276). For example, the silent interval included in the far-end voice signal is extracted and the noise component can be estimated from the extracted silent interval. The correction amount calculating unit 14 calculates the correction amount based on the magnitude of the extracted far-end noise component. For example, the correction amount calculating unit 14 calculates the correction amount to be smaller, the greater the extracted far-end noise component is.

The voice processing apparatus 10 depicted in FIG. 9 may be configured to include the AGC 17 that performs the constant-gain control, such as the noise processing apparatus 10 depicted in FIG. 1.

An example of the far-end voice signal acquired by the far-end voice acquiring unit 11 according to the second embodiment is the same as that in the first embodiment (see, e.g. FIG. 2). An example of the far-end voice signal whose band has been expanded by the pseudo band expanding unit 12 according to the second embodiment is the same as that in the first embodiment (see, e.g., FIG. 3). An example of the operation of the voice processing apparatus 10 according to the second embodiment is the same as that in the first embodiment (see, e.g., FIG. 4).

Figure 10:
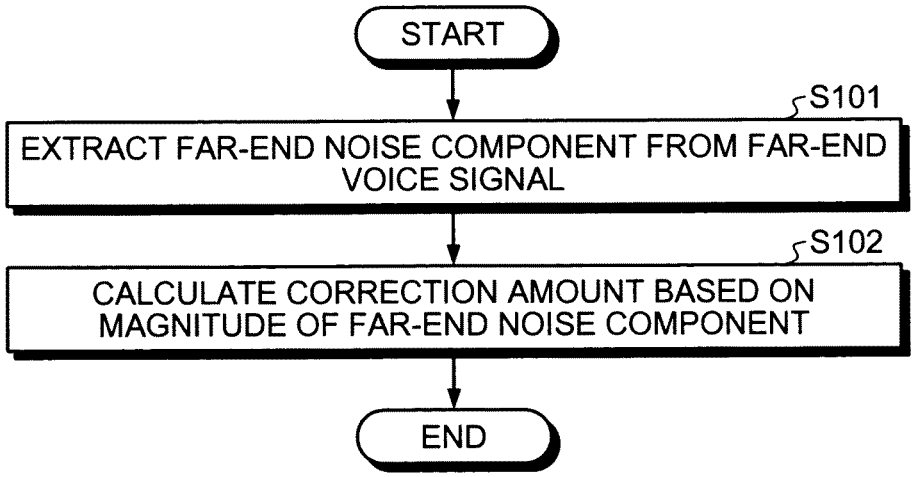
FIG. 10 is a flowchart of one example of an operation of calculating the correction amount according to the second embodiment.

FIG. 10 is a flowchart of one example of an operation of calculating the correction amount according to the second embodiment. The correction amount calculating unit 14 calculates the correction amount, for example, by the following steps. The correction amount calculating unit 14 firstly extracts a far-end noise component from the far-end voice signal (step S101). The correction amount calculating unit 14 then calculates the correction amount based on the magnitude of the far-end noise component extracted at step S101 (step S102), ending a sequence of operations.

Figure 11:
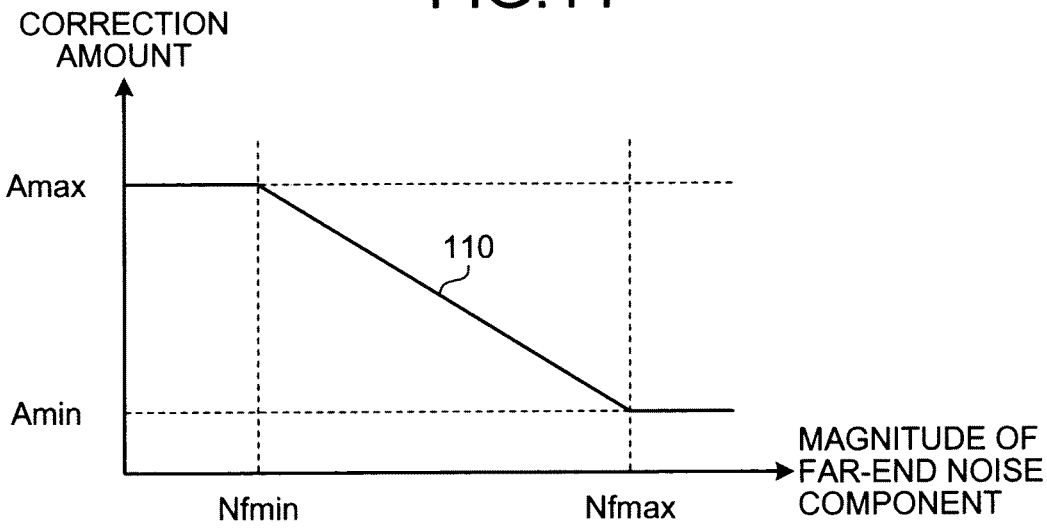
FIG. 11 is a graph of a relationship of the far-end noise component and the correction amount.

FIG. 11 is a graph of a relationship of the far-end noise component and the correction amount. In FIG. 11, the horizontal axis represents the magnitude of the far-end noise component and the vertical axis represents the correction amount calculated by the correction amount calculating unit 14. Nfmin along the horizontal axis is a minimum value (e.g., −50 [dB]) of the far-end noise component. Nfmax along the horizontal axis is a maximum value (e.g., 50 [dB]) of the far-end noise component.

With respect to the correction amount of the frequency i=FB to FE, the correction amount calculating unit 14 calculates the correction amount Ai of the frequency i, for example, according to equation (3). Nfi is the magnitude of the far-end noise component at the frequency i. k is the index of the frequency used for generation of the component of the frequency i by the pseudo band expanding unit 12. If the band is expanded by the full-wave rectification, etc., in the pseudo band expanding unit 12 and the index of the frequency used for the generation of the component of the frequency i is not determined, then the index is given as k=i−m, where m is the index corresponding to the maximum frequency of the far-end voice signal input to the pseudo band expanding unit 12.

$$Ai = A\max + \frac{A\min - A\max}{Nf\max - Nf\min}(Nfk - Nf\min) \tag{3}$$

By calculating the correction amount according to equation (3), the relationship of the far-end noise component and the correction amount is a relationship 110 depicted in FIG. 11. Thus, the correction amount calculating unit 14 calculates a smaller correction amount, the greater far-end noise component is. The correction amount calculating unit 14 determines the correction amount of the frequency i (0 to FB−1) of the narrowband component of the far-end voice signal as Ai=1.0.

Since the far-end noise component included in the voice signal is also expanded when the band of the far-end voice signal is expanded, if the far-end noise component included in the far-end voice signal is great, voice quality greatly deteriorates. To cope with this, a correction amount is calculated that makes the power of the expansion band component smaller, the greater the far-end noise component is so that when the far-end noise is great, the power of the expansion band component can be made small and the deterioration of the voice quality can be prevented. Consequently, the quality can be enhanced of the voice to be reproduced based on the far-end voice signal.

The correction of the expansion band component by the correcting unit 15 according to the second embodiment is the same as in the first embodiment (see, e.g., equation (2)). An example of the application of the voice processing apparatus 10 according to the second embodiment is the same as that in the first embodiment (see, e.g., FIGS. 7 and 8).

Thus, the voice processing apparatus 10 according to the second embodiment is capable of adjusting the balance of the effect and the side-effect of the band expansion by correcting the power of the expansion band component of the far-end voice signal by the correction amount that is based on the noise component included in the far-end voice signal. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

Figure 12:
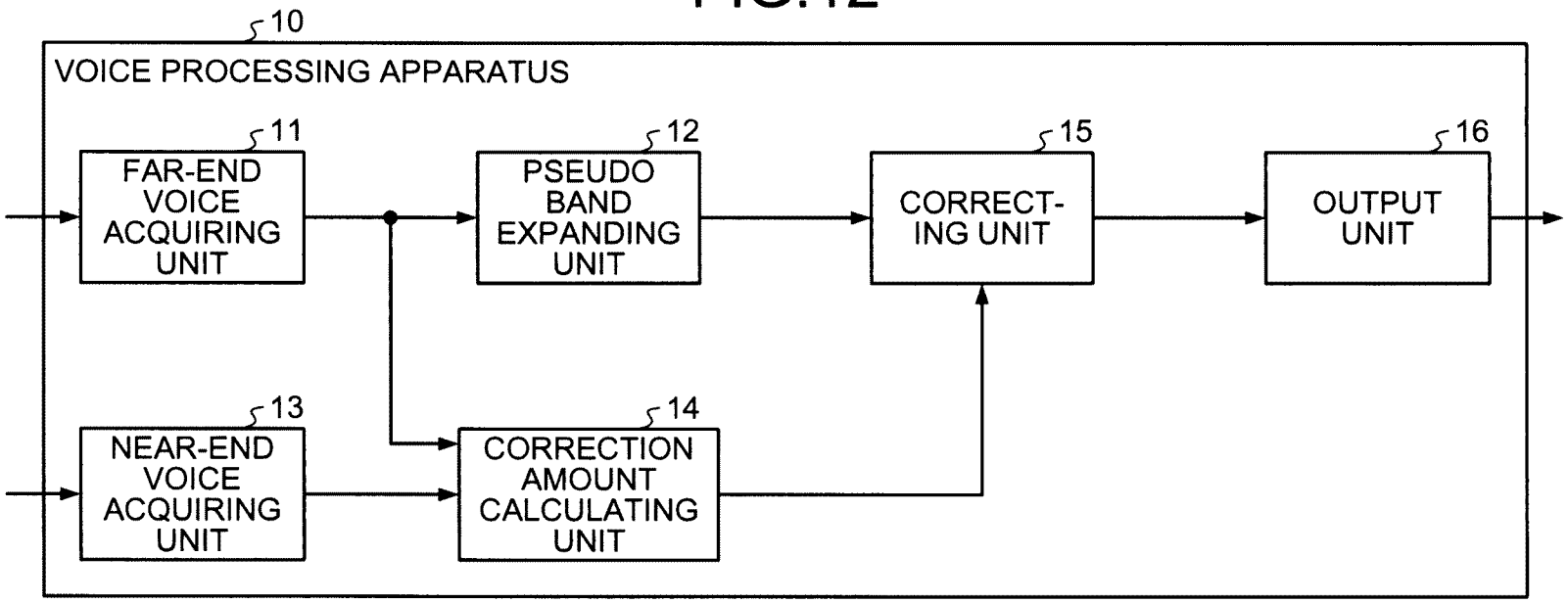
FIG. 12 is a block diagram of the voice processing apparatus according to a third embodiment.

FIG. 12 is a block diagram of the voice processing apparatus according to a third embodiment. In FIG. 12, components identical to those depicted in FIG. 1 are given the same reference numerals used in FIG. 1 and description thereof is omitted. As depicted in FIG. 12, the far-end voice acquiring unit 11 of the voice processing apparatus 10 according to the third embodiment outputs the acquired far-end voice signal to the pseudo band expanding unit 12 and the correction amount calculating unit 14.

The correction amount calculating unit 14 calculates the correction amount based on the ratio of the near-end noise component to the far-end noise component, the near-end noise component being included in the near-end voice signal output from the near-end voice acquiring unit 13 and the far-end noise component being included in the far-end voice signal output from the far-end voice acquiring unit 11. For example, the correction amount calculating unit 14 extracts the far-end noise component from the far-end voice signal and further extracts the near-end noise component from the near-end voice signal. The correction amount calculating unit 14 calculates the ratio of the extracted near-end noise component to the extracted far-end noise component and calculates the correction amount based on the calculated ratio. For example, the correction amount calculating unit 14 calculates a greater correction amount, the higher the calculated ratio is.

The voice processing apparatus 10 depicted in FIG. 12 may be configured to have the AGC 17 that performs the constant-gain control, like the voice processing apparatus 10 depicted in FIG. 1.

An example of the far-end voice signal acquired by the far-end voice acquiring unit 11 according to the third embodiment is the same as that in the first embodiment (see, e.g. FIG. 2). An example of the far-end voice signal whose band has been expanded by the pseudo band expanding unit 12 according to the third embodiment is the same as that in the first embodiment (see, e.g., FIG. 3). An example of the operation of the voice processing apparatus 10 according to the third embodiment is the same as that in the first embodiment (see, e.g., FIG. 4).

Figure 13:
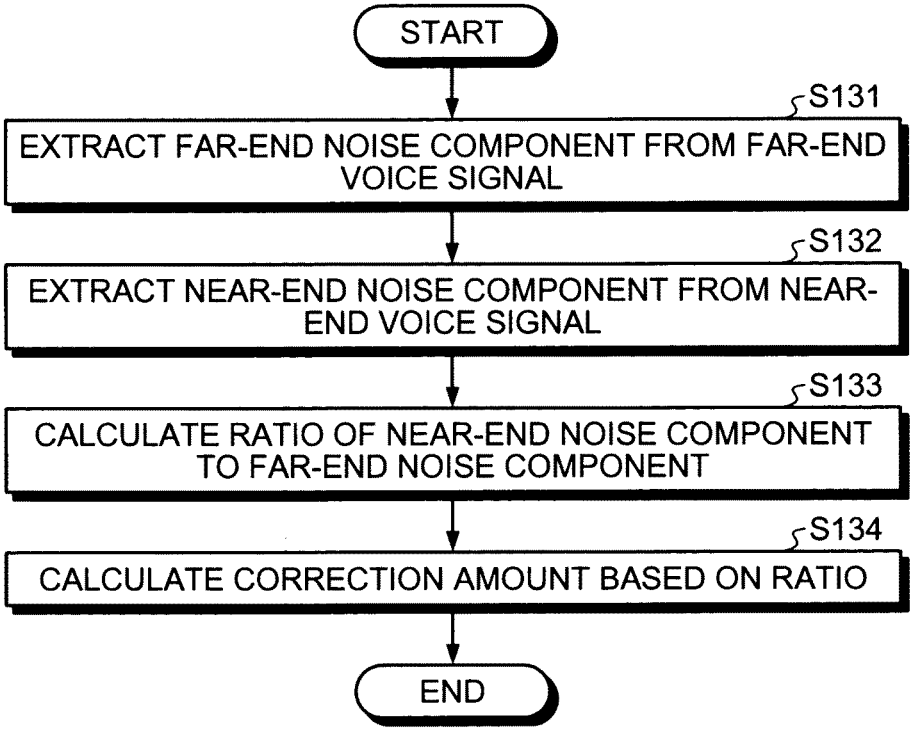
FIG. 13 is a flowchart of one example of an operation of calculating the correction amount according to the third embodiment.

FIG. 13 is a flowchart of one example of an operation of calculating the correction amount according to the third embodiment. The correction amount calculating unit 14 calculates the correction amount, for example, by the following steps. The correction amount calculating unit 14 extracts a far-end noise component from the far-end voice signal (step S131) and extracts a near-end noise component from the near-end voice signal (step S132). The correction amount calculating unit 14 then calculates the ratio of the near-end noise component extracted at step S132 to the far-end noise component extracted at step S131 (step S133) and based on the calculated ratio, calculates the correction amount (step S134), ending a sequence of operations.

Figure 14:
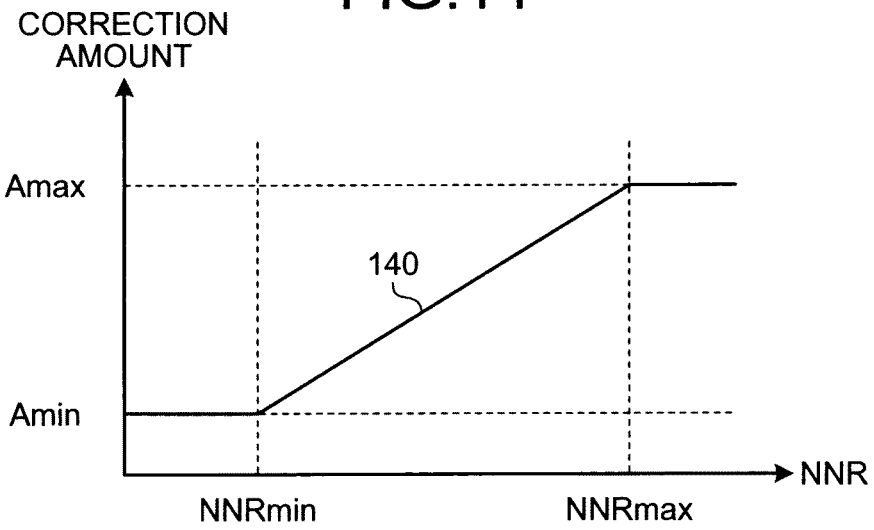
FIG. 14 is a graph of a relationship of the correction amount and the ratio of the near-end noise component to the far-end noise component.

FIG. 14 is a graph of a relationship of the correction amount and the ratio of the near-end noise component to the far-end noise component. In FIG. 14, the horizontal axis represents the ratio of the near-end noise component to the far-end noise component (NNR) and the vertical axis represents the correction amount calculated by the correction amount calculating unit 14. NNRmin along the horizontal axis is a minimum value (e.g., −50 [dB]) of the ratio of the near-end noise component to the far-end noise component. NNRmax along the horizontal axis is a maximum value (e.g., 50 [dB]) of the ratio of the near-end noise component to the far-end noise component.

With respect to the correction amount of the frequency i=FB to FE, the correction amount calculating unit 14 calculates the correction amount Ai of the frequency i, for example, according to equation (4). NNRi is the ratio of the near-end noise component to the far-end noise component at the frequency i, where NNRi=Ni−Nfk.

$$Ai = A\min + \frac{A\max - A\min}{NNR\max - NNR\min}(NNRi - NNR\min) \quad (4)$$

By calculating the correction amount according to equation (4), the relationship of the correction amount and the ratio of the near-end noise component to the far-end noise component is a relationship 140 depicted in FIG. 14. Thus, the correction amount calculating unit 14 calculates a greater correction amount, the higher the ratio is. The correction amount calculating unit 14 determines the correction amount of the frequency i (0 to FB−1) of the narrowband component of the far-end voice signal as Ai=1.0.

When the noise near the reproducing device that reproduces the far-end voice signal is great, the masking amount of the expansion band component becomes great and the effect of the band expansion of the far-end voice signal becomes difficult to perceive by the user. On the other hand, when the far-end noise component included in the far-end voice signal is great, the far-end noise component is expanded as well by the band expansion of the far-end voice signal and therefore, deterioration of the voice quality becomes great.

To cope with this, the expansion band component can be corrected so that the effect of the band expansion can be easily perceived by the user and the deterioration of the voice quality can be suppressed, by calculating a correction amount that makes the power of the expansion band component greater, the higher the ratio of the near-end noise component to the far-end noise component is. Consequently, the quality can be enhanced of the voice to be reproduced based on the far-end voice signal.

The correction of the expansion band component by the correcting unit 15 according to the third embodiment is the same as in the first embodiment (see, e.g., equation (2)). An example of the application of the voice processing apparatus 10 according to the third embodiment is the same as that in the first embodiment (see, e.g., FIGS. 7 and 8).

Thus, the voice processing apparatus 10 according to the third embodiment is capable of adjusting the balance of the effect and the side-effect of the band expansion by correcting the power of the expansion band component of the far-end voice signal by the correction amount that is based on the ratio of the near-end noise component to the far-end noise component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

The configuration of the voice processing apparatus 10 according to a fourth embodiment is the same as that in the third embodiment (see, e.g., FIG. 12), except that the correction amount calculating unit 14 calculates the correction amount based on the ratio of the voice component included in the far-end voice signal output from the far-end voice acquiring unit 11 to the near-end noise component included in the near-end voice signal output from the near-end voice acquiring unit 13. The voice component included in the far-end voice signal is the components included in the far-end voice signal, excluding the far-end noise component. For example, the correction amount calculating unit 14 extracts the near-end noise component from the near-end voice signal and extracts the voice component from the far-end voice signal.

Various methods are available for the extraction of the voice component from the far-end voice signal (see, e.g., Japanese Patent Laid-Open Publication No. 2005-165021). The correction amount calculating unit 14 calculates the ratio of the voice component to the extracted near-end noise component and calculates the correction amount based on the calculated ratio. For example, the correction amount calculating unit 14 calculates a greater correction amount, the higher the calculated ratio is.

An example of the far-end voice signal acquired by the far-end voice acquiring unit 11 according to the fourth embodiment is the same as that in the first embodiment (see, e.g. FIG. 2). An example of the far-end voice signal whose band has been expanded by the pseudo band expanding unit 12 according to the fourth embodiment is the same as that in the first embodiment (see, e.g., FIG. 3). An example of the operation of the voice processing apparatus 10 according to the fourth embodiment is the same as that in the first embodiment (see, e.g., FIG. 4).

Figure 15:
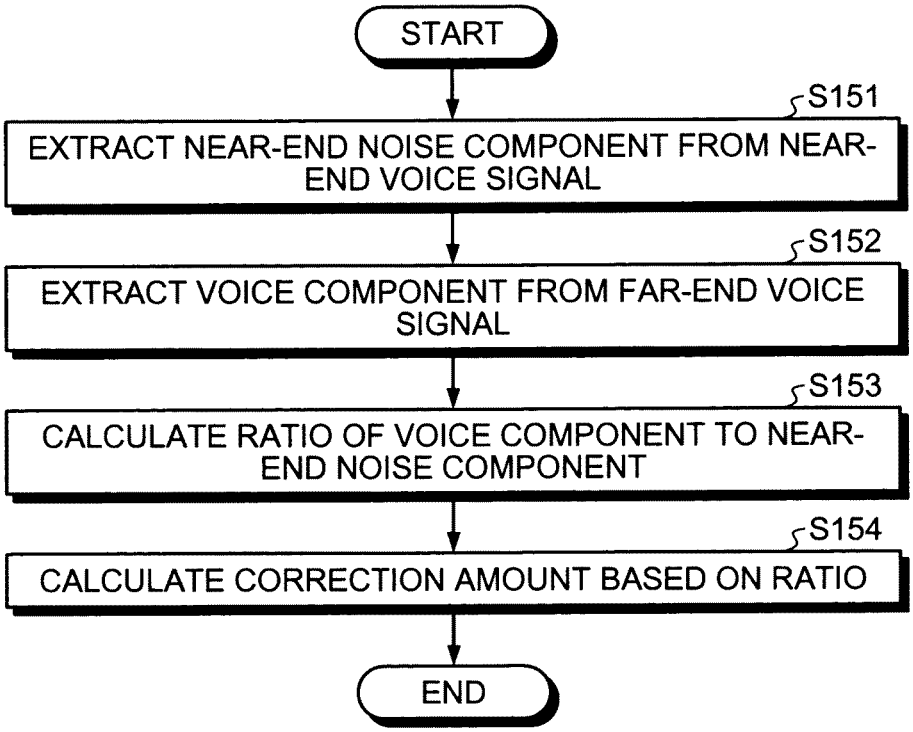
FIG. 15 is a flowchart of one example of an operation of calculating the correction amount according to a fourth embodiment.

FIG. 15 is a flowchart of one example of an operation of calculating the correction amount according to the fourth embodiment. The correction amount calculating unit 14 calculates the correction amount, for example, by the following steps. The correction amount calculating unit 14 extracts a near-end noise component from the near-end voice signal (step S151) and extracts a voice component from the far-end voice signal (step S152). The correction amount calculating unit 14 then calculates the ratio of the voice component extracted at step S152 to the near-end noise component extracted at step S151 (step S153) and based on the calculated ratio, calculates the correction amount (step S154), ending a sequence of operations.

Figure 16:
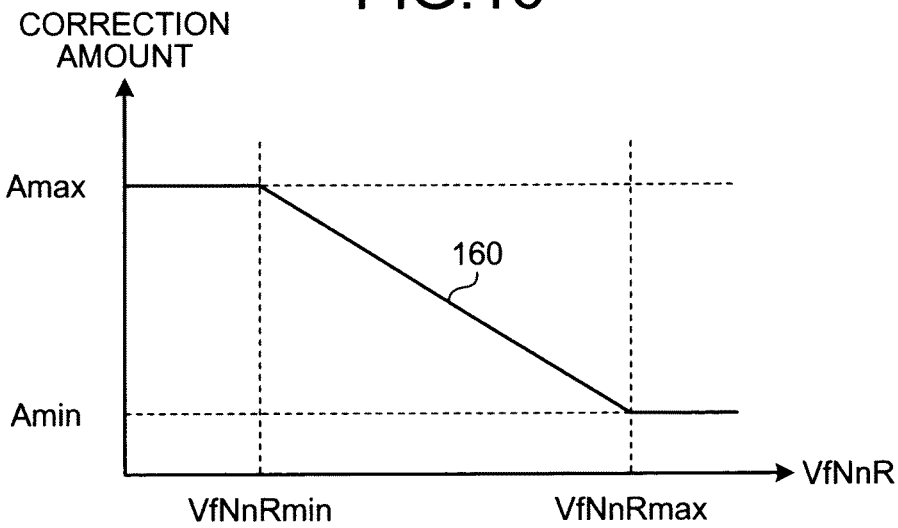
FIG. 16 is a graph of a relationship of the correction amount and the ratio of a voice component to the near-end noise component.

FIG. 16 is a graph of a relationship of the correction amount and the ratio of the voice component to the near-end noise component. In FIG. 16, the horizontal axis represents the ratio of the voice component to the near-end noise component (VfNnR) and the vertical axis represents the correction amount calculated by the correction amount calculating unit 14. VfNnRmin along the horizontal axis is a minimum value (e.g., −50 [dB]) of the ratio of the voice component to the near-end noise component. VfNnRmax along the horizontal axis is a maximum value (e.g., 50 [dB]) of the ratio of the voice component to the near-end noise component.

With respect to the correction amount of the frequency i=FB to FE, the correction amount calculating unit 14 calculates the correction amount Ai of the frequency i, for example, according to equation (5). VfNnRi is the ratio of the voice component to the near-end noise component at the frequency i, where VfNnRi=Vfk−Nni. Vfk is the magnitude of the voice component at frequency k and Nni is the magnitude of the near-end noise component at the frequency i.

$$Ai = A\max + \frac{A\min - A\max}{VfNnR\max - VfNnR\min}(VfNnRi - VfNnR\min) \quad (5)$$

By calculating the correction amount according to equation (5), the relationship of the correction amount and the ratio of the voice component to the near-end noise component is a relationship 160 depicted in FIG. 16. Thus, the correction amount calculating unit 14 calculates a smaller correction amount, the higher the ratio is. The correction amount calculating unit 14 determines the correction amount of the frequency i (0 to FB−1) of the narrowband component of the far-end voice signal as Ai=1.0.

When the noise (near-end noise component) near the reproducing device that reproduces the far-end voice signal is great, the masking amount of the expansion band component becomes great and the effect of the band expansion of the far-end voice signal becomes difficult to perceive by the user. On the other hand, the smaller the far-end voice signal is, the smaller the power expansion band component is that is generated, whereby the effect of enhancing voice quality by the band expansion of the far-end voice signal diminishes.

Thus, as the ratio of the voice component to the near-end noise component becomes higher, the effect of the masking amount of the expansion band component becomes greater than the effect of the enhancement of the voice quality by the band expansion of the far-end voice signal. In other words, as the ratio of the voice component to the near-end noise component becomes lower, the effect of the enhancement of the voice quality by the band expansion of the far-end voice signal becomes greater than the effect of the masking amount of the expansion band component.

The correction amount calculating unit 14 calculates a correction amount that makes the power of the expansion band component smaller, the higher the ratio of the voice component to the near-end noise component is, enabling correction of the power of the expansion band component so that the effect by the band expansion can be easily perceived by the user, and increased enhancement of the voice quality by the band expansion of the far-end voice signal, whereby the quality can be enhanced of the voice to be reproduced based on the far-end voice signal.

The correction of the expansion band component by the correcting unit 15 according to the fourth embodiment is the same as in the first embodiment (see, e.g., equation (2)). An example of the application of the voice processing apparatus 10 according to the fourth embodiment is the same as that in the first embodiment (see, e.g., FIGS. 7 and 8).

Thus, the voice processing apparatus 10 according to the fourth embodiment is capable of adjusting the balance of the effect and the side-effect of the band expansion by correcting the power of the expansion band component of the far-end voice signal by the correction amount that is based on the ratio of the voice component to the near-end noise component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

Figure 17:
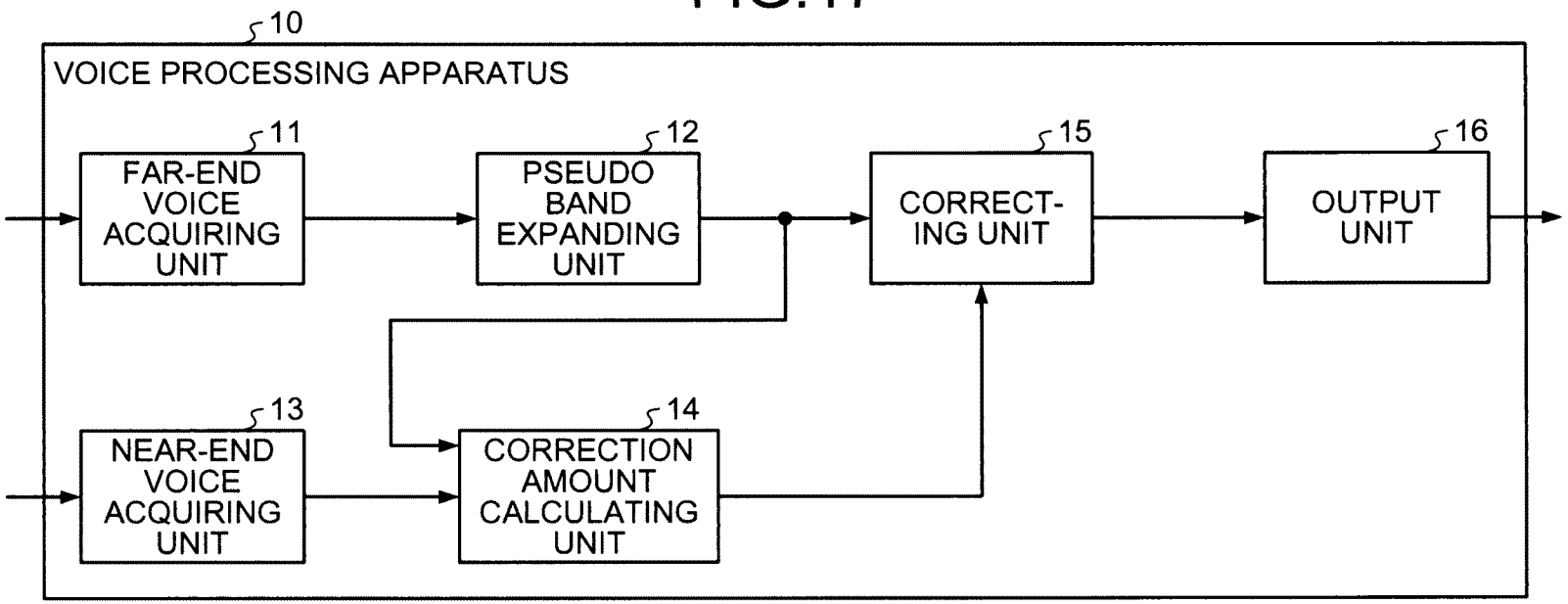
FIG. 17 is a block diagram of the voice processing apparatus according to a fifth embodiment.

FIG. 17 is a block diagram of the voice processing apparatus according to a fifth embodiment. In FIG. 17, components identical to those depicted in FIG. 1 are given the same reference numerals used in FIG. 1 and description thereof is omitted. As depicted in FIG. 17, the pseudo band expanding unit 12 in the voice processing apparatus 10 according to the fifth embodiment outputs to the correcting unit 15 and the correction amount calculating unit 14, the far-end voice signal whose band has been expanded.

The correction amount calculating unit 14 calculates the correction amount based on the ratio of the far-end voice signal output from the pseudo band expanding unit 12 to the near-end noise component included in the near-end voice signal output from the near-end voice acquiring unit 13. For example, the correction amount calculating unit 14 extracts the near-end noise component from the near-end voice signal. The correction amount calculating unit 14 then calculates the ratio of the far-end voice signal to the extracted near-end noise component and calculates the correction amount, based on the calculated ratio. For example, the correction amount calculating unit 14 calculates a smaller correction amount, the higher the calculated ratio is.

The voice processing apparatus 10 depicted in FIG. 17 may be configured to have the AGC 17 that performs the constant-gain control, like the voice processing apparatus 10 depicted in FIG. 1.

An example of the far-end voice signal acquired by the far-end voice acquiring unit 11 according to the fifth embodiment is the same as that in the first embodiment (see, e.g. FIG. 2). An example of the far-end voice signal whose band has been expanded by the pseudo band expanding unit 12 according to the fifth embodiment is the same as that in the first embodiment (see, e.g., FIG. 3). An example of the operation of the voice processing apparatus 10 according to the fifth embodiment is the same as that in the first embodiment (see, e.g., FIG. 4).

Figure 18:
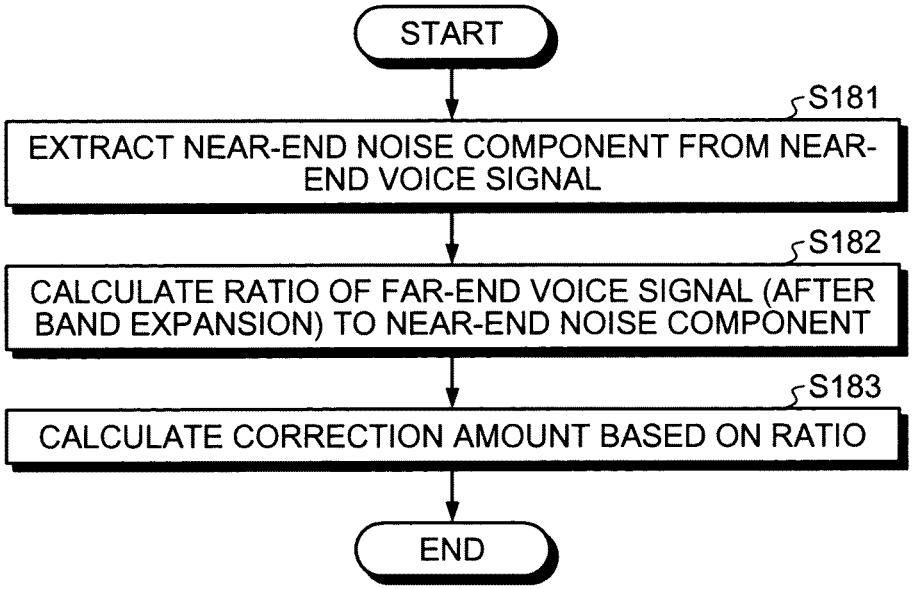
FIG. 18 is a flowchart of one example of an operation of calculating the correction amount according to the fifth embodiment.

FIG. 18 is a flowchart of one example of an operation of calculating the correction amount according to the fifth embodiment. The correction amount calculating unit 14 calculates the correction amount, for example, by the following steps. The correction amount calculating unit 14 extracts the near-end noise component from the near-end voice signal (step S181). The correction amount calculating unit 14 then calculates the ratio of the far-end voice signal, whose band has been expanded by the pseudo band expanding unit 12, to the near-end noise component extracted at step S181 (step S182). The correction amount calculating unit 14 then calculates the correction amount based on the ratio calculated at step S182 (step S183), ending a sequence of calculating operations.

Figure 19:
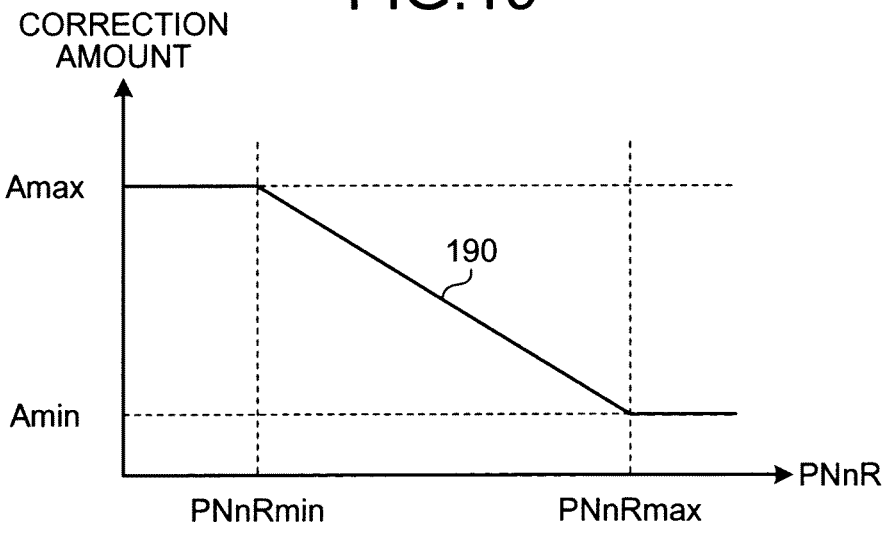
FIG. 19 is a graph of a relationship of the correction amount and the ratio of the far-end voice signal (after the band expansion) to the near-end noise component.

FIG. 19 is a graph of a relationship of the correction amount and the ratio of the far-end voice signal (after the band expansion) to the near-end noise component. In FIG. 19, the horizontal axis represents the ratio (PNnR) of the far-end voice signal (after the band expansion) to the near-end noise component and the vertical axis represents the correction amount calculated by the correction amount calculating unit 14. PNnRmin along the horizontal axis is a minimum value (e.g., −50 [dB]) of the ratio of the far-end voice signal (after the band expansion) to the near-end noise component. PNnRmax along the horizontal axis is a maximum value (e.g., 50 [dB]) of the ratio of the far-end voice signal (after the band expansion) to the near-end noise component.

With respect to the correction amount of the frequency i=FB to FE, the correction amount calculating unit 14 calculates the correction amount Ai of the frequency i, for example, according to equation (6). PNnRi is the ratio of the far-end voice signal (after the band expansion) to the near-end noise component at the frequency i, where PNnRi=Pi−Nni. Pi is the magnitude of the far-end voice signal whose band has been expanded by the pseudo band expanding unit 12, at the frequency i.

$$Ai = Amax + \frac{Amin - Amax}{PNnRmax - PNnRmin}(PNnRi - PNnRmin) \tag{6}$$

By calculating the correction amount according to equation (6), the relationship of the correction amount and the ratio of the far-end voice signal (after the band expansion) to the near-end noise component is a relationship 190 depicted in FIG. 19. Thus, the correction amount calculating unit 14 calculates a smaller correction amount, the higher the ratio is. The correction amount calculating unit 14 determines the correction amount of the frequency i (0 to FB−1) of the narrowband component of the far-end voice signal as Ai=1.0.

When the noise (near-end noise component) near the reproducing device that reproduces the far-end voice signal is great, the masking amount of the expansion band component becomes great and the effect of the band expansion of the far-end voice signal becomes difficult to perceive by the user. On the other hand, the smaller the far-end voice signal (after band expansion) is, the smaller the effect of enhancing voice quality by the band expansion of the far-end voice signal is.

To cope with this, the correction amount calculating unit 14 calculates a correction amount that makes the power of the expansion band component smaller, the higher the ratio of the far-end voice signal (after the band expansion) to the near-end noise component is, enabling correction of the power of the expansion band component so that the effect of the band expansion will be easily perceived by the user, and increased enhancement of the voice quality by the band expansion of the far-end voice signal, whereby the quality can be enhanced of the voice to be reproduced based on the far-end voice signal.

The correction of the expansion band component by the correcting unit 15 according to the fifth embodiment is the same as in the first embodiment (see, e.g., equation (2)). The example of the application of the voice processing apparatus 10 according to the fifth embodiment is the same as in the first embodiment (see, e.g., FIGS. 7 and 8).

Thus, the voice processing apparatus 10 according to the fifth embodiment is capable of adjusting the balance of the effect and the side-effect of the band expansion by correcting the power of the expansion band component of the far-end voice signal by the correction amount that is based on the ratio of the far-end voice signal (after the band expansion) to the near-end noise component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

The configuration of the voice processing apparatus 10 according to a sixth embodiment is the same as in the first embodiment (see, e.g., FIG. 1), except that the correction amount calculating unit 14 calculates the correction amount based on the stationarity of the near-end noise component included in the near-end voice signal output from the near-end voice acquiring unit 13. For example, the correction amount calculating unit 14 extracts the near-end noise component from the near-end voice signal and calculates the stationarity of the extracted near-end noise component. The correction amount calculating unit 14 calculates the correction amount based on the calculated stationarity. For example, the correction amount calculating unit 14 calculates a smaller correction amount, the higher the calculated stationarity is.

An example of the far-end voice signal acquired by the far-end voice acquiring unit 11 according to the sixth embodiment is the same as that in the first embodiment (see, e.g. FIG. 2). An example of the far-end voice signal whose band has been expanded by the pseudo band expanding unit 12 according to the sixth embodiment is the same as that in the first embodiment (see, e.g., FIG. 3). An example of the operation of the voice processing apparatus 10 according to the sixth embodiment is the same as that in the first embodiment (see, e.g., FIG. 4).

Figure 20:
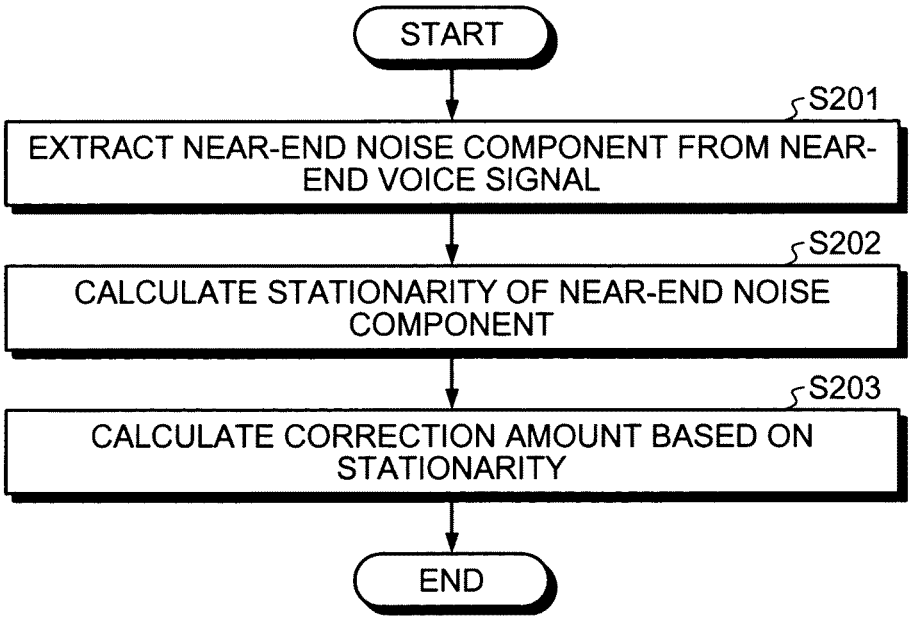
FIG. 20 is a flowchart of one example of an operation of calculating the correction amount according to a sixth embodiment.

FIG. 20 is a flowchart of one example of an operation of calculating the correction amount according to the sixth embodiment. The correction amount calculating unit 14 calculates the correction amount, for example, by the following steps. The correction amount calculating unit 14 extracts a near-end noise component from the near-end voice signal (step S201) and calculates the stationarity of the extracted near-end noise component (step S202). The correction amount calculating unit 14 then calculates based on the calculated stationarity, the correction amount (step S203), ending a sequence of operations.

Figure 21:
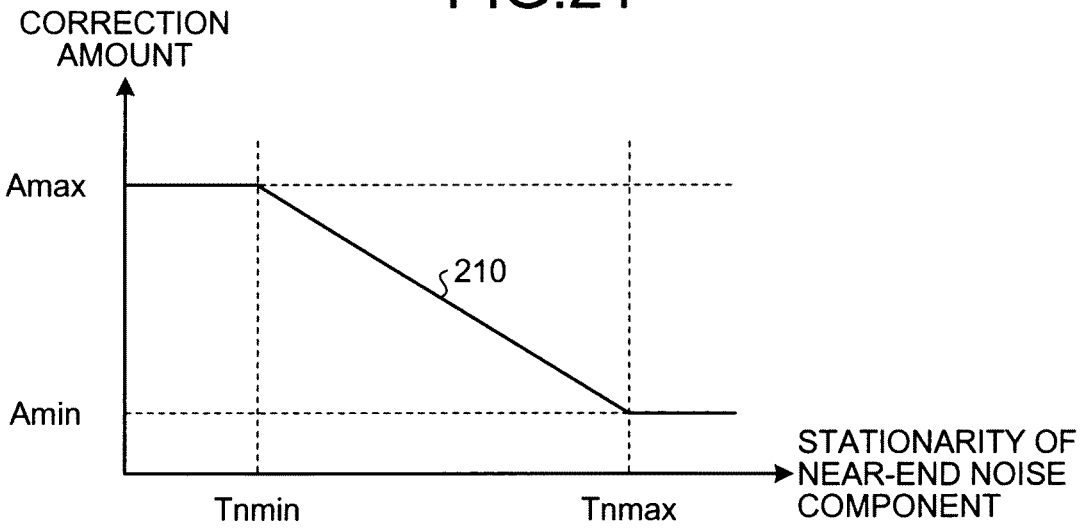
FIG. 21 is a graph of a relationship of the correction amount and the stationarity of the near-end noise component.

FIG. 21 is a graph of a relationship of the correction amount and the stationarity of the near-end noise component. In FIG. 21, the horizontal axis represents the stationarity of the near-end noise component and the vertical axis represents the correction amount calculated by the correction amount calculating unit 14. Tnmin along the horizontal axis is a minimum value (e.g., 0.0) of the stationarity of the near-end noise component. Tnmax along the horizontal axis is a maximum value (e.g., 1.0) of the stationarity of the near-end noise component. With respect to the correction amount of the frequency i=FB to FE, the correction amount calculating unit 14 calculates the correction amount Ai of the frequency i, for example, according to equation (7). Tni is the stationarity of the near-end noise component at the frequency i.

$$Ai = A\max + \frac{A\min - A\max}{Tn\max - Tn\min}(Tni - Tn\min) \tag{7}$$

By calculating the correction amount according to equation (7), the relationship of the correction amount and the stationarity of the near-end noise component is a relationship 210 depicted in FIG. 21. Thus, the correction amount calculating unit 14 calculates a smaller correction amount, the higher the stationarity of the near-end noise component is. The correction amount calculating unit 14 determines the correction amount of the frequency i (0 to FB−1) of the narrowband component of the far-end voice signal as Ai=1.0.

Generally, the voice of a higher stationarity is more difficult for the user to perceive. For example, the higher the stationarity is of the noise (near-end noise component) near the reproducing device that reproduces far-end voice signal, the more difficult it becomes for the user to perceive the noise and consequently, the smaller the masking amount of the expansion band component becomes. On the other hand, the lower the stationarity is of the noise (near-end noise component) near the reproducing device that reproduces far-end voice signal, the easier it becomes for the user to perceive the noise and consequently, the greater the masking amount of the expansion band component becomes.

To cope with this, the correction amount calculating unit 14 calculates a correction amount that makes the power of the expansion band component smaller, the higher the stationarity of the near-end noise component is, enabling the power of the expansion band component to be small, suppressing the deterioration of the voice quality, when it becomes easy for the user to perceive the expansion band component. Thus, the quality can be enhanced of the voice to be reproduced based on the far-end noise signal.

Figure 22:
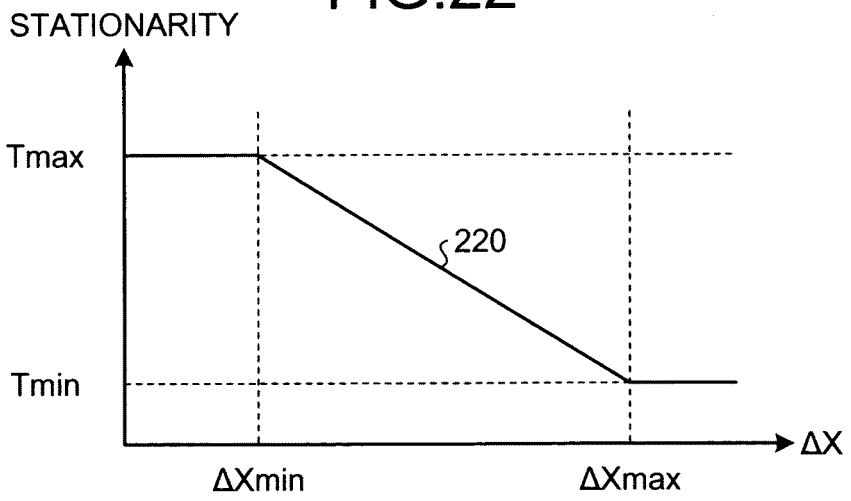
FIG. 22 is a graph of a relationship of the stationarity and a power spectral difference between frames.

FIG. 22 is a graph of a relationship of the stationarity and a power spectral difference between frames. In FIG. 22, the horizontal axis represents the power spectral difference (ΔX) between the frames of the near-end noise component, the vertical axis representing the stationarity calculated by the correction amount calculating unit 14. ΔXmin along the horizontal axis is a minimum value (e.g., −0.1) of the power spectral difference between the frames of the near-end noise component. ΔXmax along the horizontal axis is a maximum value (e.g., 0.3) of the power spectral difference between the frames of the near-end noise component. Tmin along the vertical axis is a minimum value of the stationarity. Tmax along the vertical axis is a maximum value of the stationarity.

With respect to the frequency i=0 to FN/2−1, the correction amount calculating unit 14 calculates a power spectrum Xi at the frequency i of the current frame, for example, according to equation (8). SPi_RE is the real part of a complex spectrum of the signal of the current frame. SPi_im is the imaginary part of the complex spectrum of the signal of the current frame.

$$Xi=SPi_RE\times SPi_RE+SPi_im\times SPi_im \tag{8}$$

The correction amount calculating unit 14 calculates an average power spectrum Ei, for example, according to equation (9) with respect to the frequency i=0 to FN/2−1, based on the calculated power spectrum Xi. Ei_prev is the average power spectrum of a previous frame. coef is an updating coefficient (0<coef<1).

$$Ei=\text{coef}\times Xi+(1-\text{coef})\times Ei_\text{prev} \tag{9}$$

The correction amount calculating unit 14 calculates a difference ΔXi, for example, according to equation (10) with respect to the frequency i=0 to FN/2−1, based on the calculated power spectrum Xi and average power spectrum Ei. The difference ΔXi is the difference at the frequency i of the power spectrum and that of the previous frame, normalized by the average power spectrum Ei. Xi_prev is the power spectrum at the frequency i of the previous frame.

$$\Delta Xi=(Xi-Xi_\text{prev})/Ei \tag{10}$$

The correction amount calculating unit 14 calculates stationarity Ti at the frequency i, for example, according to equation (11) with respect to the frequency i=0 to FN/2−1, based on the calculated difference ΔXi. Ti is the stationarity at the frequency i of the near-end noise component. Tmin is a minimum value (e.g., 0.0) of the stationarity of the near-end noise component. Tmax is a maximum value (e.g., 1.0) of the stationarity of the near-end noise component.

$$Ti = T\max + \frac{T\min - T\max}{\Delta X\max - \Delta X\min}(\Delta Xi - \Delta X\min) \tag{11}$$

The relationship of the difference ΔXi of the power spectrum between the frames and the stationarity Ti is as indicated by a relationship 220 depicted in FIG. 22 by calculating the stationarity Ti according to equation (11). Thus, the stationarity Ti becomes lower as the difference ΔXi of the power spectrum between the frames becomes greater.

The correction of the expansion band component by the correcting unit 15 according to the sixth embodiment is the same as that in the first embodiment (see, e.g., equation (2)). An example of the application of the voice processing apparatus 10 according to the sixth embodiment is the same as that in the first embodiment (see, e.g., FIGS. 7 and 8).

Thus, the voice processing apparatus 10 according to the sixth embodiment is capable of adjusting the balance of the effect and the side-effect of the band expansion by correcting the power of the expansion band component of the far-end voice signal by the correction amount that is based on the stationarity of the near-end noise component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

The configuration of the voice processing apparatus 10 according to a seventh embodiment is the same as in the second embodiment (see, e.g., FIG. 9), except that the correction amount calculating unit 14 calculates the correction amount based on the stationarity of the far-end noise component included in the far-end voice signal output from the far-end voice acquiring unit 11. For example, the correction amount calculating unit 14 extracts the far-end noise component from the far-end voice signal and calculates the stationarity of the extracted far-end noise component. The correction amount calculating unit 14 calculates the correction amount based on the calculated stationarity. For example, the correction amount calculating unit 14 calculates a smaller correction amount, the higher the calculated stationarity is.

An example of the far-end voice signal acquired by the far-end voice acquiring unit 11 according to the seventh embodiment is the same as that in the first embodiment (see, e.g. FIG. 2). An example of the far-end voice signal whose band has been expanded by the pseudo band expanding unit 12 according to the seventh embodiment is the same as that in the first embodiment (see, e.g., FIG. 3). An example of the operation of the voice processing apparatus 10 according to the seventh embodiment is the same as that in the first embodiment (see, e.g., FIG. 4).

Figure 23:
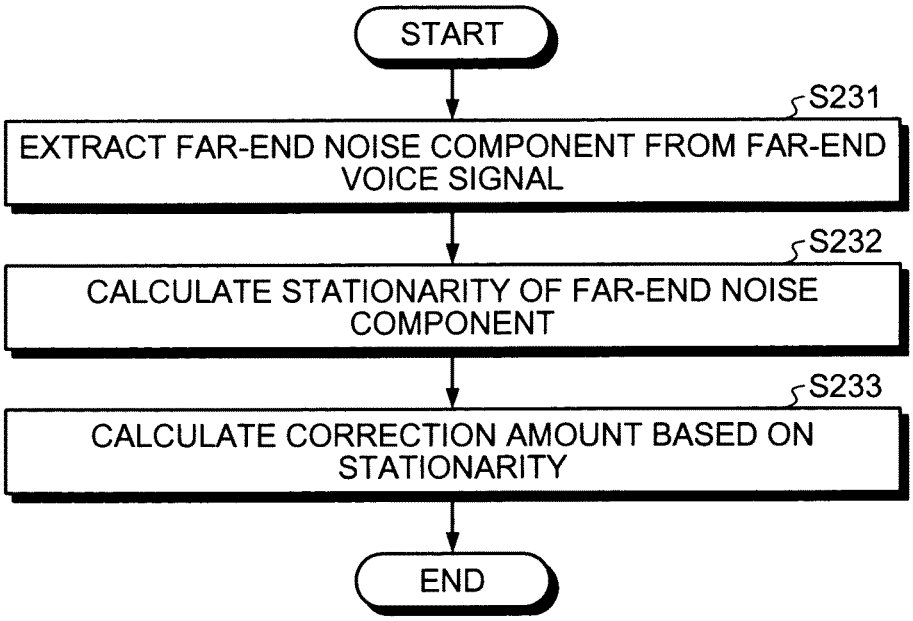
FIG. 23 is a flowchart of one example of an operation of calculating the correction amount according to a seventh embodiment.

FIG. 23 is a flowchart of one example of an operation of calculating the correction amount according to the seventh embodiment. The correction amount calculating unit 14 calculates the correction amount, for example, by the following steps. The correction amount calculating unit 14 extracts a far-end noise component from the far-end voice signal (step S231) and calculates the stationarity of the extracted far-end noise component (step S232). The correction amount calculating unit 14 then calculates based on the calculated stationarity, the correction amount (step S233), ending a sequence of operations.

Figure 24:
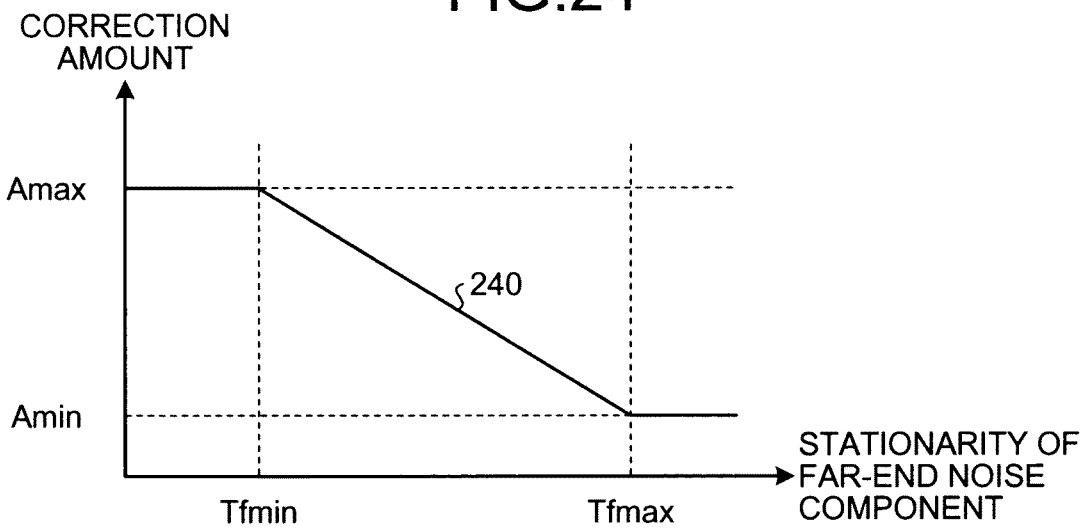
FIG. 24 is a graph of a relationship of the correction amount and the stationarity of the far-end noise component.

FIG. 24 is a graph of a relationship of the correction amount and the stationarity of the far-end noise component. In FIG. 24, the horizontal axis represents the stationarity of the far-end noise component and the vertical axis represents the correction amount calculated by the correction amount calculating unit 14. Tfmin along the horizontal axis is a minimum value (e.g., −50 [dB]) of the stationarity of the far-end noise component. Tfmax along the horizontal axis is a maximum value (e.g., 50 [dB]) of the stationarity of the far-end noise component. With respect to the correction amount of the frequency i=FB to FE, the correction amount calculating unit 14 calculates the correction amount Ai of the frequency i, for example, according to equation (12).

$$Ai = A\max + \frac{A\min - A\max}{Tf\max - Tf\min}(Tfk - Tn\min) \tag{12}$$

By calculating the correction amount according to equation (12), the relationship of the correction amount and the stationarity of the far-end noise component is a relationship 240 depicted in FIG. 24. Thus, the correction amount calculating unit 14 calculates a smaller correction amount, the higher the stationarity of the far-end noise component is. The correction amount calculating unit 14 determines the correction amount of the frequency i (0 to FB−1) of the narrowband component of the far-end voice signal as Ai=1.0.

Generally, the higher the stationarity of the voice is, the more difficult it is for the user to perceive the voice. For example, the higher the stationarity of the far-end noise component is, the more difficult it becomes for the user to perceive the far-end noise component and as a result, the masking amount of the expansion band component becomes smaller. On the other hand, the lower the stationarity of the far-end noise component is, the easier it becomes for the user to perceive the far-end noise component and as a result, the masking amount of the expansion band component becomes greater.

To cope with this, the correction amount calculating unit 14 calculates a correction amount that makes the power of the expansion band component smaller, the higher the stationarity of the far-end noise component is, enabling the power of the expansion band component to be small, suppressing the deterioration of the voice quality, when it becomes easy for the user to perceive the expansion band component. Thus, the quality can be enhanced of the voice to be reproduced based on the far-end noise signal.

The calculation of the stationarity of the far-end noise component by the correction amount calculating unit 14 according to the seventh embodiment is the same as the calculation of the stationarity of the near-end noise component in the sixth embodiment (see, e.g., equations (8) to (11) and FIG. 22). The correction of the expansion band component by the correcting unit 15 according to the seventh embodiment is the same as in the first embodiment (see, e.g., equation (2)). An example of the application of the voice processing apparatus 10 according to the seventh embodiment is the same as that in the first embodiment (see, e.g., FIGS. 7 and 8).

Thus, the voice processing apparatus 10 according to the seventh embodiment is capable of adjusting the balance of the effect and the side-effect of the band expansion by correcting the power of the expansion band component of the far-end voice signal by the correction amount that is based on the stationarity of the far-end noise component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

The configuration of the voice processing apparatus 10 according to an eighth embodiment is the same as that in the third embodiment (see, e.g., FIG. 12), except that the correction amount calculating unit 14 calculates the correction amount based on the similarity of the far-end noise component included in the far-end voice signal output from the far-end voice acquiring unit 11 and the near-end noise component included in the near-end voice signal output from the near-end voice acquiring unit 13.

For example, the correction amount calculating unit 14 extracts the far-end noise component from the far-end voice signal as well as the near-end noise component from the near-end voice signal and calculates the similarity of the extracted far-end noise component and near-end noise component. The correction amount calculating unit 14 calculates the correction amount based on the calculated similarity. For example, the correction amount calculating unit 14 calculates a greater correction amount, the higher the calculated similarity is.

An example of the far-end voice signal acquired by the far-end voice acquiring unit 11 according to the eighth embodiment is the same as that in the first embodiment (see, e.g. FIG. 2). An example of the far-end voice signal whose band has been expanded by the pseudo band expanding unit 12 according to the eighth embodiment is the same as that in the first embodiment (see, e.g., FIG. 3). An example of the operation of the voice processing apparatus 10 according to the eighth embodiment is the same as that in the first embodiment (see, e.g., FIG. 4).

Figure 25:
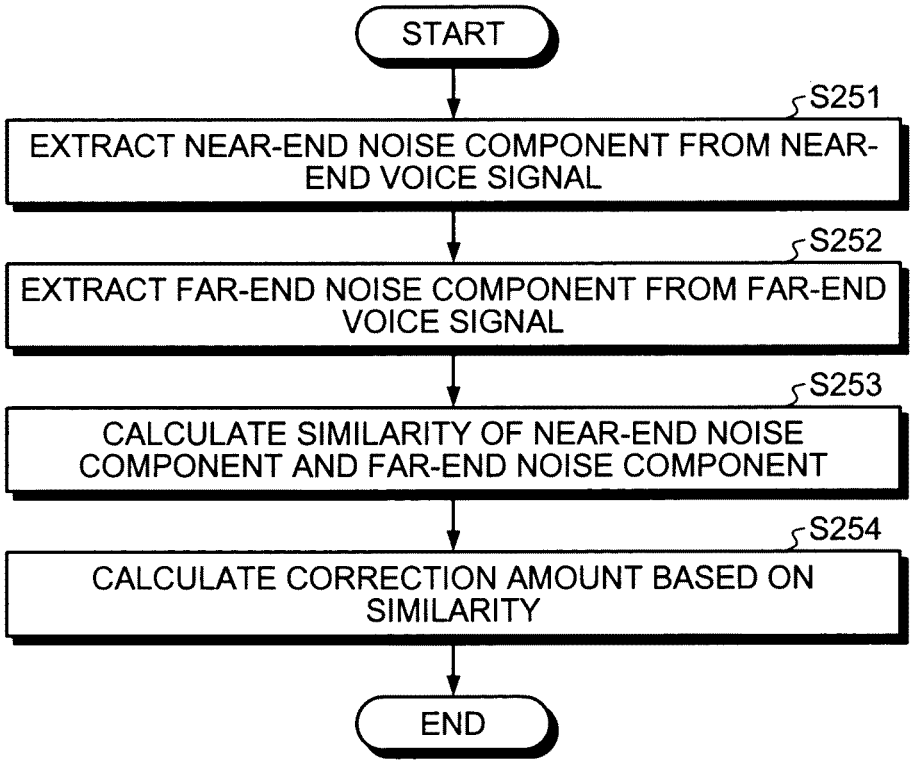
FIG. 25 is a flowchart of one example of an operation of calculating the correction amount according to an eighth embodiment.

FIG. 25 is a flowchart of one example of an operation of calculating the correction amount according to the eighth embodiment. The correction amount calculating unit 14 calculates the correction amount, for example, by the following steps. The correction amount calculating unit 14 extracts the near-end noise component from the near-end voice signal (step S251) and further extracts the far-end noise component from the far-end voice signal (step S252). The correction amount calculating unit 14 then calculates the similarity of the near-end noise component extracted at step S251 and the far-end noise component extracted at step S252 (step S253). The correction amount calculating unit 14 then calculates the correction amount based on the similarity calculated at step S253 (step S254), ending a sequence of calculating operations.

Figure 26:
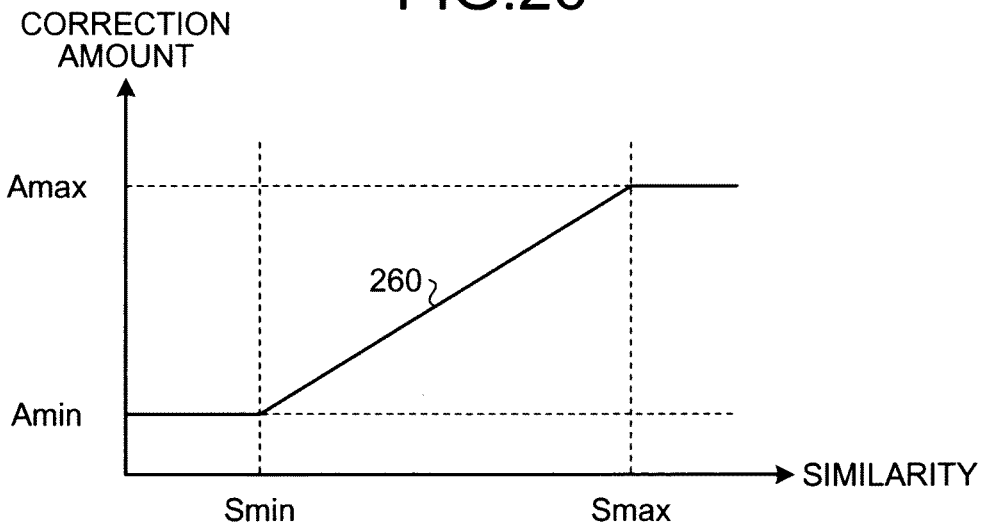
FIG. 26 is a graph of a relationship of the correction amount and the similarity of the near-end noise component and the far-end noise component.

FIG. 26 is a graph of a relationship of the correction amount and the similarity of the near-end noise component and the far-end noise component. In FIG. 26, the horizontal axis represents the similarity of the near-end noise component and the far-end noise component and the vertical axis represents the correction amount calculated by the correction amount calculating unit 14. Smin along the horizontal axis is a minimum value (e.g., 0.0) of the similarity of the near-end noise component and the far-end noise component. Smax along the horizontal axis is a maximum value (e.g., 1.0) of the similarity of the near-end noise component and the far-end noise component. With respect to the correction amount of the frequency i=FB to FE, the correction amount calculating unit 14 calculates the correction amount Ai of the frequency i, for example, according to equation (13).

$$Ai = Amin + \frac{Amax - Amin}{Smax - Smin}(S - Smin) \tag{13}$$

By calculating the correction amount according to equation (13), the relationship of the correction amount and the similarity of the near-end noise component and the far-end noise component tunes is as indicated by a relationship 260 depicted in FIG. 26. Thus, the correction amount calculating unit 14 calculates a greater correction amount, the higher the similarity of the near-end noise component and the far-end noise component is. The correction amount calculating unit 14 determines the correction amount for the frequency i (i=0 to FB−1) of the narrowband component of the far-end voice signal as Ai=1.0.

Generally, the more similar sounds are, the more difficult it is for the user distinguish the sounds. For example, the higher the similarity of the near-end noise component and the far-end noise component is, the higher the similarity of the near-end noise component and the expansion band component of the far-end voice signal is and therefore, it becomes more difficult for the user to perceive the expansion band component. On the other hand, the lower the similarity of the near-end noise component and the far-end noise component is, the lower the similarity of the near-end noise component and the expansion band component of the far-end voice signal is and therefore, it becomes easier for the user to perceive the expansion band component.

To cope with this, the correction amount calculating unit 14 calculates a correction amount that makes the power of the expansion band component greater, the higher the similarity of the near-end noise component and the far-end noise component is, enabling the power of the expansion band component to be greater and making it easier for the user to perceive the effect of the band expansion. Thus, the quality can be enhanced of the voice to be reproduced based on the far-end voice signal.

Figure 27:
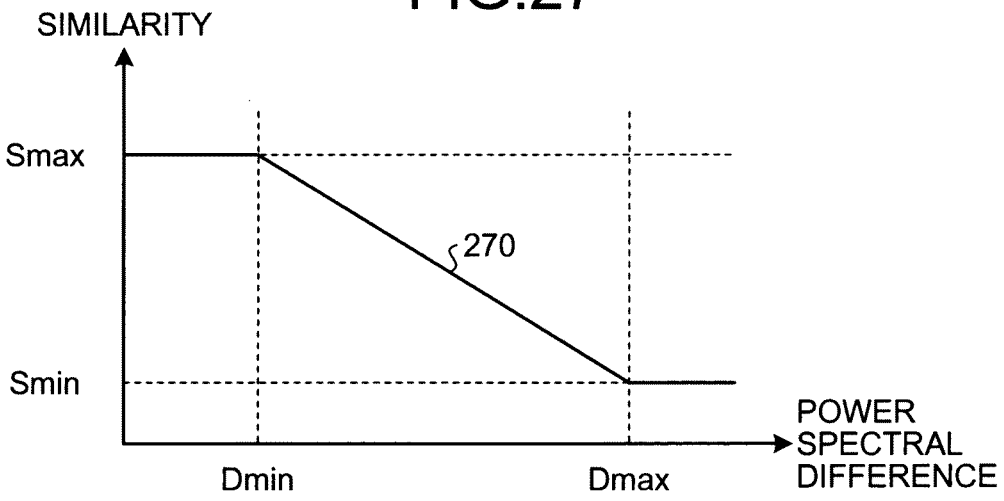
FIG. 27 is a graph of a relationship of the power spectral difference of the noise components and the similarity.

FIG. 27 is a graph of a relationship of the power spectral difference of the noise components and the similarity. In FIG. 27, the horizontal axis represents the power spectral difference of the near-end noise component and the far-end noise component and the vertical axis represents the similarity to be calculated by the correction amount calculating unit 14. Dmin along the horizontal axis is a minimum value (e.g., 0.0) of the power spectral difference of the near-end noise component and the far-end noise component. Dmax along the horizontal axis is a maximum value (e.g., 1.0) of the power spectral difference of the near-end noise component and the far-end noise component. Smin along the vertical axis is a minimum value (e.g., 0.0) of the similarity. Smax along the vertical axis is a maximum value (e.g., 1.0) of the similarity.

The correction amount calculating unit 14 calculates with respect to the frequency i=0 to FN/2−1, a normalized power spectrum XNi of the near-end noise component at the frequency i for the current frame, for example, according to equation (14). SPNi_re is the real part of the complex spectrum at the frequency i of the near-end noise component. SPNi_im is the imaginary part of the complex spectrum at the frequency i of the near-end noise component. s is a start index (e.g., index corresponding to 300 [Hz]). e is an end index (e.g., index corresponding to 3400 [Hz]).

$$XNi = \frac{(\mathrm{SPNi_re} \times \mathrm{SPNi_re} + \mathrm{SPNi_im} \times \mathrm{SPNi_im})}{\sum_{i=s}^{i=e} (\mathrm{SPNi_re} \times \mathrm{SPNi_re} + \mathrm{SPNi_im} \times \mathrm{SPNi_im})} \tag{14}$$

The correction amount calculating unit 14 calculates with respect to the frequency i=0 to FN/2−1, a normalized power spectrum XFi of the far-end noise component at the frequency i of the current frame, for example, according to equation (15). SPFi_re is the real part of the complex spectrum at the frequency i of the far-end noise component. SPFi_im is the imaginary part of the complex spectrum at the frequency i of the far-end noise component. s is the start index (e.g., index corresponding to 300 [Hz]). e is the end index (e.g., index corresponding to 3400 [Hz]).

$$XFi = \frac{(\mathrm{SPFi_re} \times \mathrm{SPFi_re} + \mathrm{SPFi_im} \times \mathrm{SPFi_im})}{\sum_{i=s}^{i=e} (\mathrm{SPFi_re} \times \mathrm{SPFi_re} + \mathrm{SPFi_im} \times \mathrm{SPFi_im})} \tag{15}$$

The correction amount calculating unit 14 calculates a power spectral difference D, for example, according to equation (16), with respect to the frequency i=0 to FN/2−1, based on the calculated normalized power spectrum XNi and normalized power spectrum XFi. The power spectral difference D is the power spectral difference of the near-end noise component and the far-end noise component.

$$D = \frac{1}{e - s + 1} \sqrt{\sum_{i=s}^{i=e} (XNi - XFi)^2} \tag{16}$$

The correction amount calculating unit 14 calculates the similarity S of the near-end noise component and the far-end noise component, for example, according to equation (17), based on the calculated power spectral difference D.

$$S = S\mathrm{max} + \frac{S\mathrm{min} - S\mathrm{max}}{D\mathrm{max} - D\mathrm{min}} (D - D\mathrm{min}) \tag{17}$$

By calculating the similarity S according to equation (17), the relationship of the power spectral difference of the noise components and the similarity is as indicated by a relationship 270 depicted in FIG. 27. Thus, the lower the similarity is, the greater the power spectral difference of the noise components becomes.

The correction of the expansion band component by the correcting unit 15 according to the eighth embodiment is the same as that in the first embodiment (see, e.g., equation (2)). An example of the application of the voice processing apparatus 10 according to the eighth embodiment is the same as that in the first embodiment (see, e.g., FIGS. 7 and 8).

Thus, the voice processing apparatus 10 according to the eighth embodiment is capable of adjusting the balance of the effect and the side-effect of the band expansion by correcting the power of the expansion band component of the far-end voice signal by the correction amount that is based on the similarity of the near-end noise component and the far-end component. Consequently, the quality can be enhanced of the voice to be reproduced based on the far-end voice signal. Appropriate correction can be made with respect to plural frequencies and the quality can be further enhanced of the voice to be reproduced based on the far-end voice signal, by calculating the correction amount with respect to the plural frequencies of the expansion band components.

The voice processing apparatus 10 according to a ninth embodiment calculates plural correction amounts through the methods according to the embodiments described above and corrects the power of the expansion band component, using the plural correction amounts thus calculated. For example, the voice processing apparatus 10 separately weights and adds the correction amounts calculated through at least two of the methods according to the first to the eighth embodiments and corrects the power of the expansion band component by the added correction amounts.

A weighting coefficient of each of the correction amounts is preset according to the degree of importance of the correction amount. An example will be described of separately weighting and adding the correction amount calculated through the method according to the first embodiment and the correction amount calculated through the method according to the second embodiment and correcting the power of the expansion band component by the added correction amounts.

The configuration of the voice processing apparatus 10 according to the ninth embodiment is the same as that in the third embodiment (see, e.g., FIG. 12), except that the correction amount calculating unit 14 calculates the correction amount by respectively weighting and then summing a correction amount based on the far-end noise component included in the far-end voice signal output from the far-end voice acquiring unit 11 and a correction amount based on the near-end noise component included in the near-end voice signal output from the near-end voice acquiring unit 13. The correction amount calculating unit 14 outputs the sum of the weighted correction amounts to the correcting unit 15.

For example, the correction amount calculating unit 14 extracts the near-end noise component from the near-end voice signal and calculates the correction amount based on the extracted near-end noise component (refer to, e.g., first embodiment). The correction amount calculating unit 14 extracts the far-end noise component from the far-end voice signal and calculates the correction amount based on the extracted far-end noise component (refer to, e.g., second embodiment). The correction amount calculating unit 14 multiplies the calculated correction amounts by a weighting coefficient, respectively, and then adds the weighted correction amounts and outputs the sum to the correcting unit 15.

An example of the far-end voice signal acquired by the far-end voice acquiring unit 11 according to the ninth embodiment is the same as that in the first embodiment (see, e.g. FIG. 2). An example of the far-end voice signal whose band has been expanded by the pseudo band expanding unit 12 according to the ninth embodiment is the same as that in the first embodiment (see, e.g., FIG. 3). An example of the operation of the voice processing apparatus 10 according to the ninth embodiment is the same as that in the first embodiment (see, e.g., FIG. 4).

Figure 28:
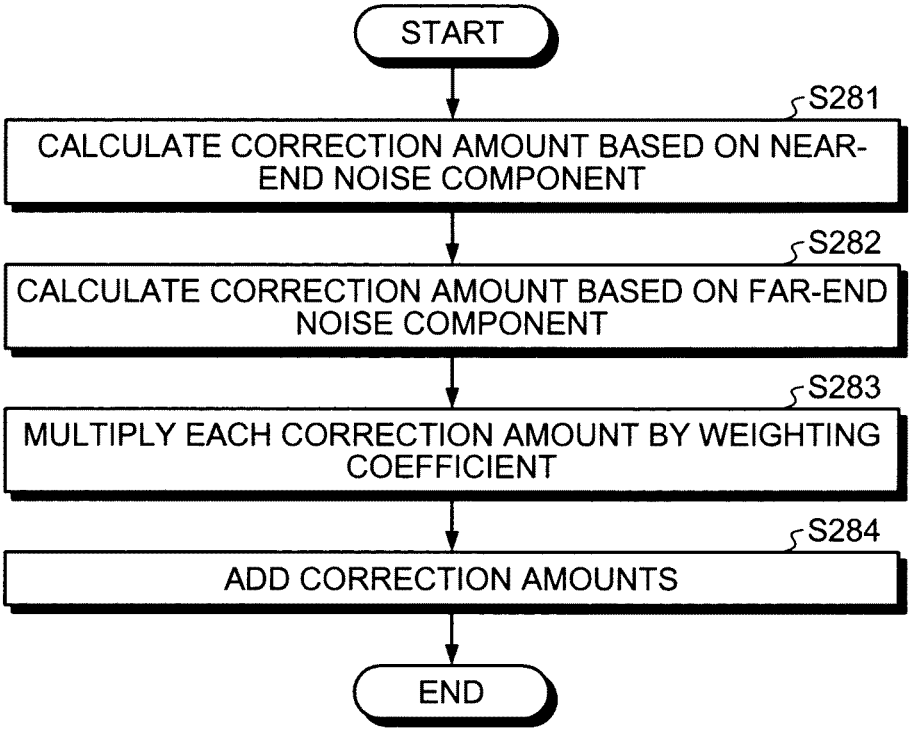
FIG. 28 is a flowchart of one example of an operation of calculating the correction amount according to a ninth embodiment.

FIG. 28 is a flowchart of one example of an operation of calculating the correction amount according to the ninth embodiment. The correction amount calculating unit 14 calculates the correction amount, for example, by the following steps. The correction amount calculating unit 14 calculates a correction amount based on the near-end noise component (step S281) and calculates a correction amount based on the far-end noise component (step S282). The correction amount calculating unit 14 then multiplies the correction amounts calculated at steps S281 and S282 by a weighting coefficient, respectively (step S283). The correction amount calculating unit 14 adds the correction amounts weighted at step S283 (step S284), ending a sequence of calculating operations.

The correction of the expansion band component by the correcting unit 15 according to the ninth embodiment is the same as that in the first embodiment (see, e.g., equation (2)). An example of the application of the voice processing apparatus 10 according to the ninth embodiment is the same as that in the first embodiment (see, e.g., FIGS. 7 and 8).

Thus, the voice processing apparatus 10 according to the ninth embodiment is capable of more flexibly adjusting the balancing of the effect and the side-effect of the band expansion by calculating the correction amounts through the plural methods and using the calculated correction amounts to correct the power of the expansion band component. Consequently, the quality can be further enhanced of the voice to be reproduced based on the far-end voice signal.

The correction amount calculating unit 14 of the voice processing apparatus 10 according to a tenth embodiment calculates plural correction amounts through any of the methods according to the embodiments described above. With respect to a band component of a predetermined width near the border between the expansion band component and the narrowband component, the correction amount calculating unit 14 outputs to the correcting unit 15, the correction amount to be determined for each frequency in such a band. Although a calculation will be described of the correction amount by the voice processing apparatus 10 according to the tenth embodiment, other processing, etc., by the voice processing apparatus 10 are the same as those in the embodiments described above.

With respect to the band component of the predetermined width near the border between the expansion band component and the narrowband component, the correction amount calculating unit 14 of the voice processing apparatus 10 according to the tenth embodiment outputs to the correcting unit 15, the correction amount to be determined for each frequency in such a band. For example, the correction amount calculating unit 14 performs smoothing of the band component of the predetermined width near the border between the expansion band component and the narrowband component (respectively among the calculated correction amounts Ai), by interpolating based on the correction amount Ai at the frequency on both sides of such a band.

Thus, it becomes possible to avoid a sharp power spike near the border between the expansion band component and the narrowband component in the far-end voice signal even after the correction of the expansion band component by the correcting unit 15, and further enhance the quality of the voice to be reproduced based on the far-end voice signal.

Figure 29:
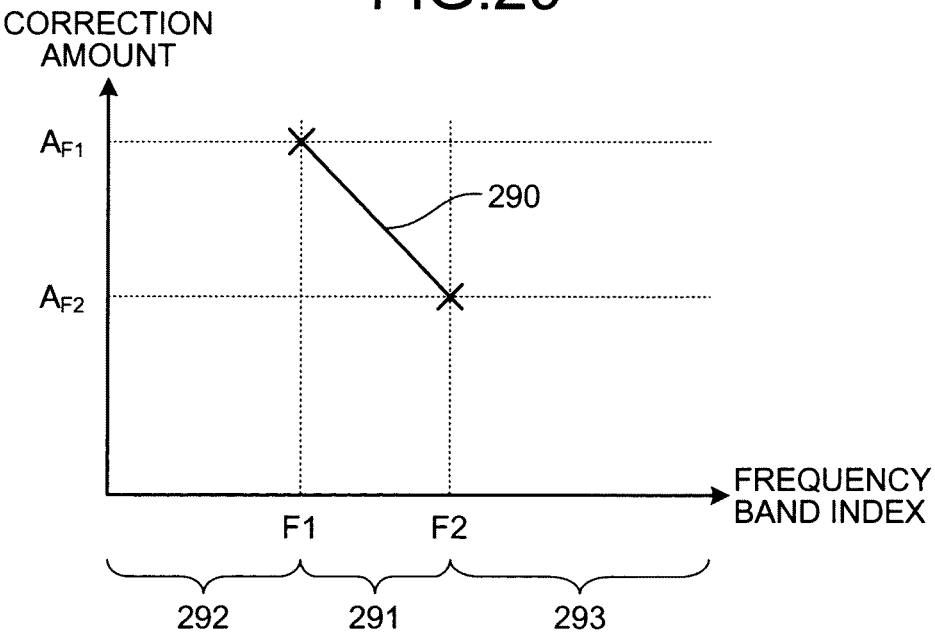
FIG. 29 depicts the interpolation near a border between an expansion band component and a narrowband component.

FIG. 29 depicts the interpolation near the border between the expansion band component and the narrowband component. In FIG. 29, the horizontal axis represents the frequency band index and the vertical axis represents the correction amount Ai. A border band 291 denotes the band component of the predetermined width near the border between the expansion band component and the narrowband component. For example, the border band 291 is established so as to include the frequency (e.g., frequency FB) of the border between the expansion band component and the narrowband component and have the predetermined width.

A band 292 denotes the band on the lower frequency side of the border band 291. A band 293 denotes the band on the higher frequency side of the border band 291. A frequency F1 is the frequency at the border between the border band 291 and the band 292. A frequency F2 is the frequency at the border between the border band 291 and the band 293. A correction amount $A_{F1}$ is the correction amount calculated by the correction amount calculating unit 14 for the frequency F1. A correction amount $A_{F2}$ is the correction amount calculated by the correction amount calculating unit 14 for the frequency F2.

The correction amount calculating unit 14 interpolates each correction amount Ai of the border band 291, for example, based on the calculated correction amount $A_{F1}$ and correction amount $A_{F2}$. For example, the correction amount calculating unit 14 calculates each correction amount Ai' after the interpolation of the border band 291 according to equation (18).

$$A_i' = A_{F1} + \frac{A_{F2} - A_{F1}}{F_2 - F_1}(i - F_1) \quad (i = F_1, \ldots, F_2) \tag{18}$$

A relationship 290 denotes the relationship of the frequency i and the correction amount Ai in the border band 291. Thus, the correction amount calculating unit 14 is capable of linearly interpolating each correction amount Ai of the border band 291, based on the calculated correction amount $A_{F1}$ and correction amount $A_{F2}$, making it possible to avoid the sharp power spike in the border band 291.

The correction amount calculating unit 14 sets each correction amount Ai' resulting from the interpolation of the band 292 and the band 293 to be the same value as that of each correction amount Ai before the interpolation. The correction amount calculating unit 14 outputs to the correcting unit 15, the correction amount Ai' resulting from the interpolation. The correcting unit 15 corrects the power of the expansion band component of the far-end voice signal, based on the correction amount Ai' output from the correction amount calculating unit 14.

The correction amount calculating unit 14 may be designed not to calculate the correction amount Ai at the frequency between the frequency F1 and the frequency F2. In this case as well, the correction amount calculating unit 14 is capable of obtaining the correction amount Ai' of the border band 291 by interpolating based on the correction amount $A_{F1}$ and the correction amount $A_{F2}$.

Thus, with respect to the band component of the predetermined width near the border between the expansion band component and the narrowband component, the voice processing apparatus 10 according to the tenth embodiment outputs the voice signal corrected by the correction amount determined for each frequency in such a band, making it possible to avoid a sharp power spike near the border between the expansion band component and the narrowband component in the far-end voice signal even after the correction of the expansion band component, and further enhance the quality of the voice to be reproduced based on the far-end voice signal.

Examples will be given of the power spectrum of the far-end voice signal before and after the correction by the correcting unit 15 of the voice processing apparatus 10 according to the embodiments described above. Here, as one example, a power spectrum is given of the far-end voice signal in the voice processing apparatus 10 depicted in FIG. 9.

FIGS. 30 to 33 depict examples of the power spectrum of the far-end voice signal. In FIGS. 30 to 33, the horizontal axis represents frequency and the vertical axis represents power. A power spectrum 300 is the power spectrum of the far-end voice signal. A narrowband component 301 is the narrowband component (e.g., i=0 to FB−1) of the far-end voice signal. An expansion band component 302 is the expansion band component (e.g., i=FB to FE) of the far-end voice signal.

Figure 30:
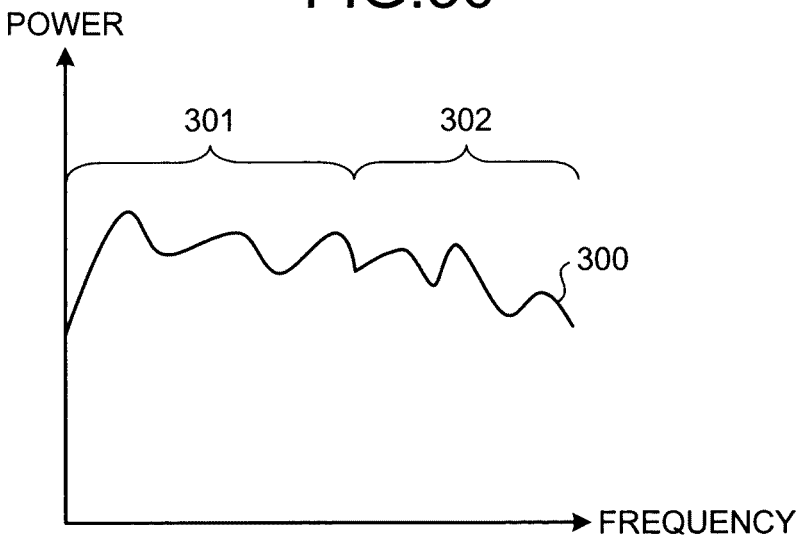
FIGS. 30, 31, 32, and 33 depict examples of the power spectrum of the far-end voice signal.
Figure 31:
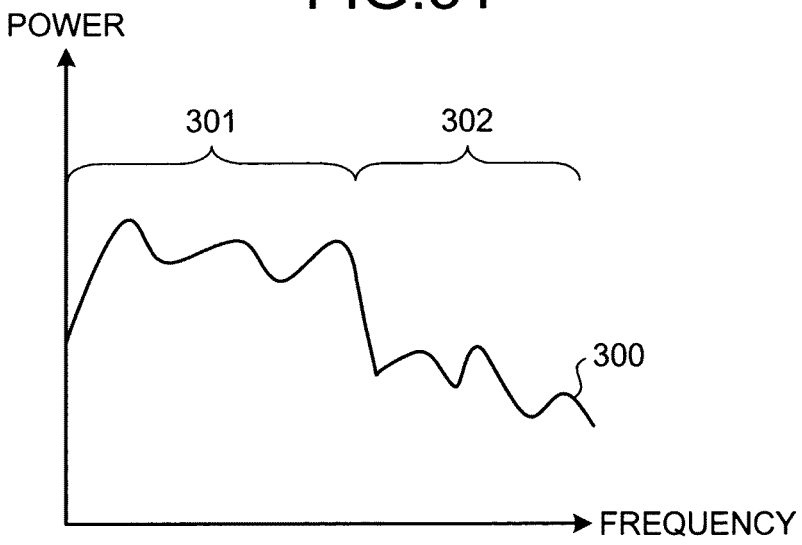

The power spectrum 300 depicted in FIG. 30 is the power spectrum of the far-end voice signal before the correction by the correcting unit 15 when the noise component included in the far-end voice signal is relatively great. The power spectrum 300 depicted in FIG. 31 is the power spectrum of the far-end voice signal after the correction by the correcting unit 15 when the noise component included in the far-end voice signal is relatively great, in the same manner as in FIG. 30. As depicted in FIGS. 30 and 31, in this case, the correction is made so as to lower the power of the expansion band component 302 of the power spectrum 300.

Figure 32:
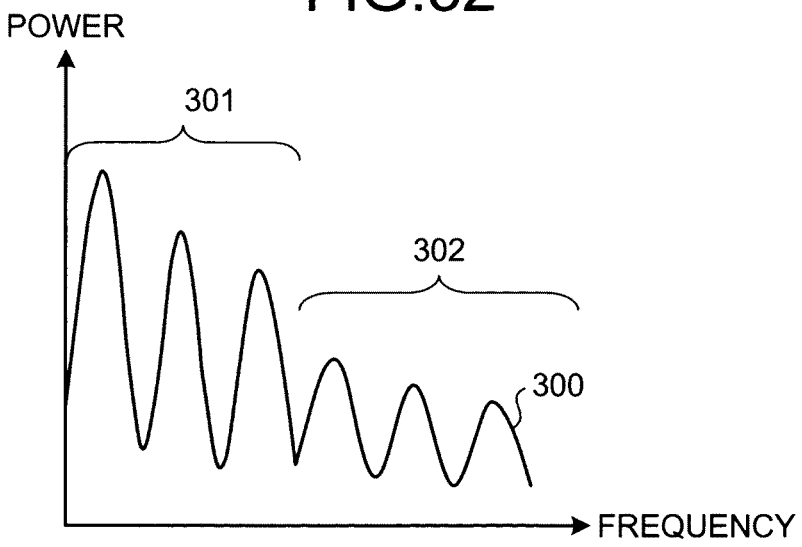
Figure 33:
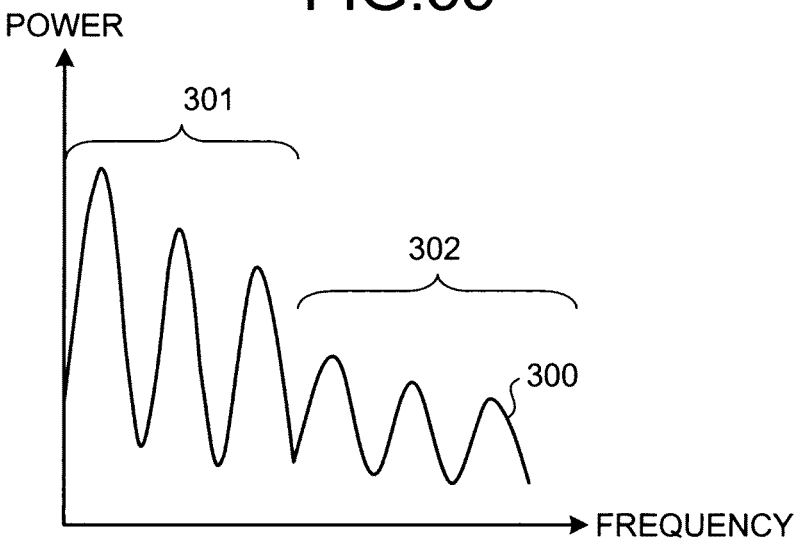

The power spectrum 300 depicted in FIG. 32 is the power spectrum of the far-end voice signal before the correction by the correcting unit 15 when the noise component included in the far-end voice signal is relatively small. The power spectrum 300 depicted in FIG. 33 is the power spectrum of the far-end voice signal after the correction by the correcting unit 15 when the noise component included in the far-end voice signal is relatively small, in the same manner as in FIG. 32. As depicted in FIGS. 32 and 33, in this case, the correction is made so as to substantially maintain the power of the expansion band component 302 of the power spectrum 300.

Variation examples will be described of the voice processing apparatus 10 according to the embodiments described above. Although the variation examples will be described of the voice processing apparatus 10 depicted in FIG. 1, the same variation is possible with respect to the other voice processing apparatuses 10 described above as well.

Figure 34:
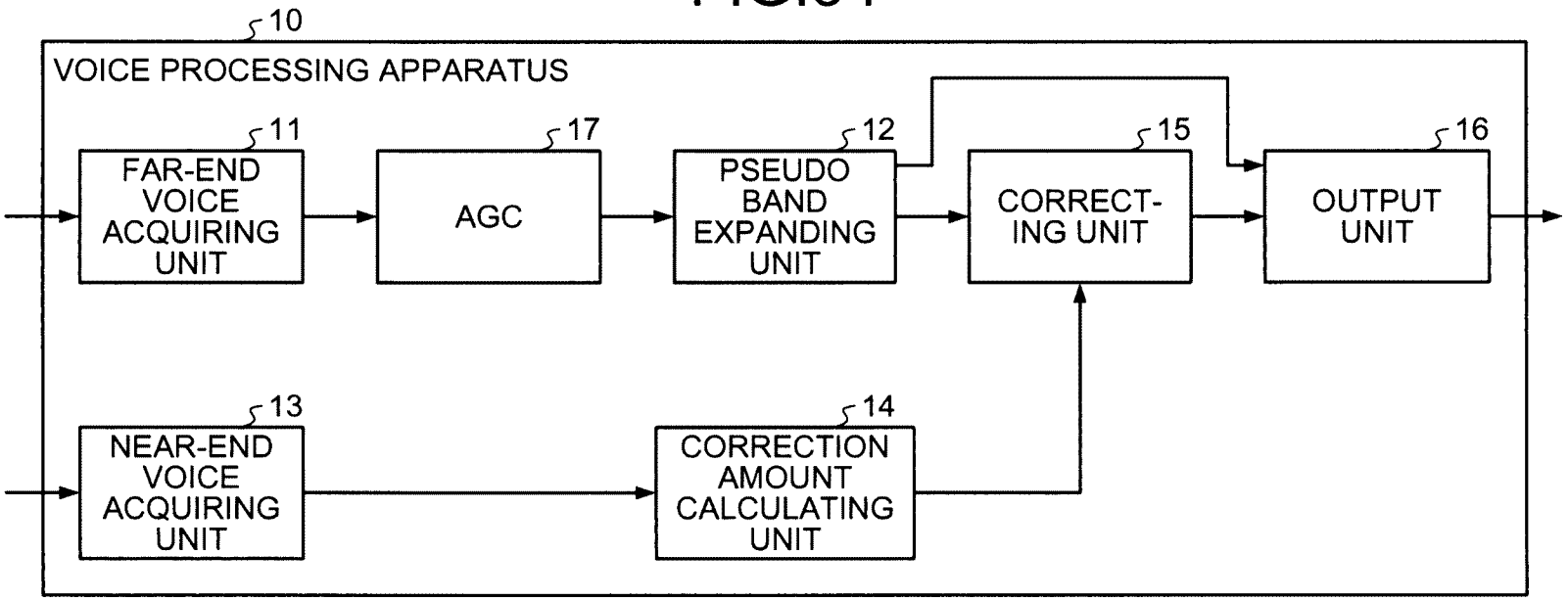
FIG. 34 is a block diagram of a first variation example of the voice processing apparatus.

FIG. 34 is a block diagram of a first variation example of the voice processing apparatus. In FIG. 34, components identical to those depicted in FIG. 1 are given the same reference numerals used in FIG. 1 and description thereof is omitted. As depicted in FIG. 34, in the voice processing apparatus 10, the narrowband component of the far-end voice signal may be output from the output unit 16 without being routed through the correcting unit 15.

For example, the pseudo band expanding unit 12 may output the narrowband component of the far-end voice signal to the output unit 16 as well as output the generated expansion band component to the correcting unit 15. The correcting unit 15 corrects the expansion band component output from the pseudo band expanding unit 12. The output unit 16 outputs the narrowband component output from the pseudo band expanding unit 12 and the far-end voice signal whose band has been expanded based on the expansion band component output from the correcting unit 15.

Though not depicted, the narrowband component of the far-end voice signal output from the far-end voice acquiring unit 11 to the pseudo band expanding unit 12 may be branched and the branched narrowband components may be output, one to the pseudo band expanding unit 12 and the other to the output unit 16. The pseudo band expanding unit 12 outputs the generated expansion band component to the correcting unit 15. The output unit 16 outputs the far-end voice signal whose band has been expanded based on the expansion band component output from the correcting unit 15 and the narrowband component output from the far-end voice acquiring unit 11.

Figure 35:
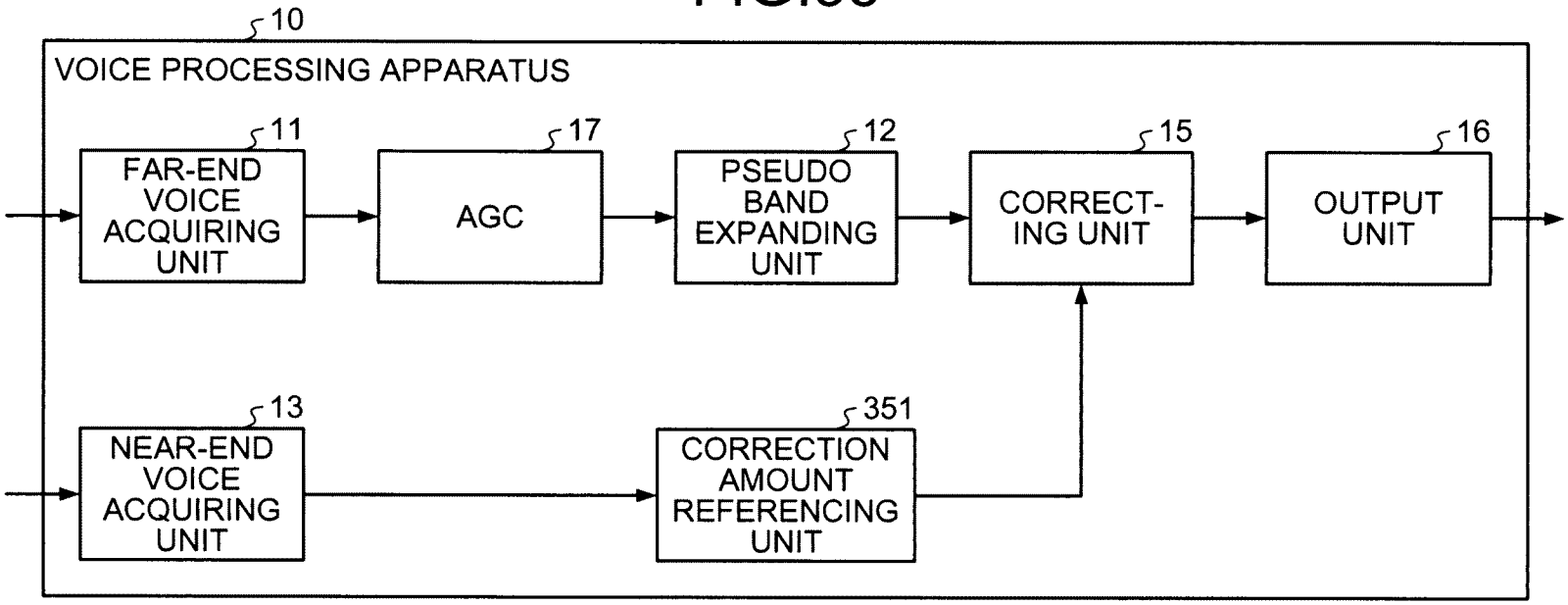
FIG. 35 is a block diagram of a second variation example of the voice processing apparatus.

FIG. 35 is a block diagram of a second variation example of the voice processing apparatus. In FIG. 35, components identical to those depicted in FIG. 1 are given the same reference numerals used in FIG. 1 and description thereof is omitted. As depicted in FIG. 35, the voice processing apparatus 10 may be equipped with a correction amount referencing unit 351 in place of the correction amount calculating unit 14. The correction amount referencing unit 351 derives the correction amount based on the near-end noise component included in the near-end noise signal output from the near-end voice acquiring unit 13 by referencing a correspondence table.

For example, a memory of the voice processing apparatus 10 stores the correspondence table relating the magnitude of the near-end noise component and the correction amount. The correction amount referencing unit 351 derives for each frequency and from the correspondence table, the correction amount corresponding to the magnitude of the near-end noise component included in the near-end voice signal output from the near-end voice acquiring unit 13. The correction amount referencing unit 351 outputs the derived correction amount to the correcting unit 15.

FIG. 36 depicts one example of the correspondence table. The memory of the voice processing apparatus 10 depicted in FIG. 35 stores, for example, a correspondence table 360 depicted in FIG. 36. In the correspondence table 360, the magnitude Ni of the near-end noise component and the correction amount Ai are correlated. The values of the correspondence table 360 are obtained, for example, by discretizing the relationship 60 depicted in FIG. 6.

With respect to the correction amount of the frequency i=FB to FE, the correction amount referencing unit 351 derives from the correspondence table, the correction amount Ai corresponding to the magnitude Ni of the near-end noise component. The correction amount referencing unit 351 determines the correction amount at the frequency i (0 to FB−1) of the narrowband component of the far-end voice signal as Ai=1.0. Thus, the voice processing apparatus 10 is not limited to the configuration of calculating the correction mount Ai according to the equations described above but may be configured to derive the correction amount Ai by referencing a table.

The item that is correlated with the correction amount Ai in the correspondence table 360 differs depending on the embodiments described above. For example, in the voice processing apparatus 10 depicted in FIG. 9, the correspondence table correlates the magnitude Nfi of the far-end noise component at the frequency i and the correction amount Ai. In the voice processing apparatus 10 depicted in FIG. 12, the correspondence table 360 correlates the ratio NNRi of the near-end noise component to the far-end noise component at the frequency i and the correction amount Ai.

As described above, the disclosed voice processing apparatus, voice processing method, and telephone apparatus correct the power of the expansion band component of the far-end voice signal by the correction amount based on the near-end voice component and the far-end voice component that influence the balancing of the effect and the side effect of the band expansion, enabling adjustment of the balance of the effect and the side effect of the band expansion, and enhancement the quality of the voice to be reproduced based on the far-end voice signal.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A voice processing apparatus comprising:

a voice signal acquiring unit that acquires a voice signal converted to plural frequency bands from an input signal having a narrowed band;

an expanding unit that generates based on a narrowband component of the voice signal acquired by the voice signal acquiring unit, an expansion band component expanding the band of the voice signal;

a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit, wherein the voice signal acquiring unit comprises:

a first acquiring unit that acquires a first voice signal having a narrowed band; and a second acquiring unit that acquires a second voice signal indicative of a voice near a reproducing device that reproduces the first voice signal, wherein the expanding unit uses the first voice signal acquired by the first acquiring unit as the voice signal acquired by the voice signal acquiring unit, the correcting unit uses the noise component included in the second voice signal acquired by the second acquiring unit as the noise component included in the voice signal acquired by the voice signal acquiring unit, and the output unit uses the first voice signal acquired by the first acquiring unit as the voice signal acquired by the voice signal acquiring unit, wherein the correcting unit corrects the power by the correction amount that is based on a ratio of the noise component included in the first voice signal and the noise component included in the second voice signal, wherein the higher the ratio is, the greater the correction amount.

2. The voice processing apparatus according to claim 1, wherein the correcting unit corrects for each frequency included in the expansion band component and by the correction amount determined based on the second voice signal acquired by the second acquiring unit.

3. A voice processing apparatus, comprising:

a voice signal acquiring unit that acquires a voice signal converted to plural frequency bands from an input signal having a narrowed band;

an expanding unit that generates based on a narrowband component of the voice signal acquired by the voice signal acquiring unit, an expansion band component expanding the band of the voice signal;

a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit, wherein the voice signal acquiring unit comprises:

a first acquiring unit that acquires a first voice signal having a narrowed band; and a second acquiring unit that acquires a second voice signal indicative of a voice near a reproducing device that reproduces the first voice signal, wherein the expanding unit uses the first voice signal acquired by the first acquiring unit as the voice signal acquired by the voice signal acquiring unit, the correcting unit uses the noise component included in the second voice signal acquired by the second acquiring unit as the noise component included in the voice signal acquired by the voice signal acquiring unit, and the output unit uses the first voice signal acquired by the first acquiring unit as the voice signal acquired by the voice signal acquiring unit, wherein the correcting unit corrects the power by the correction amount that is based on a ratio of a voice component included in the first voice signal acquired by the first acquiring unit and the noise component, wherein the higher the ratio is, the greater the correction amount.

4. A voice processing apparatus, comprising:

a voice signal acquiring unit that acquires a voice signal converted to plural frequency bands from an input signal having a narrowed band;

an expanding unit that generates based on a narrowband component of the voice signal acquired by the voice signal acquiring unit, an expansion band component expanding the band of the voice signal;

a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit, wherein the voice signal acquiring unit comprises:

a first acquiring unit that acquires a first voice signal having a narrowed band; and a second acquiring unit that acquires a second voice signal indicative of a voice near a reproducing device that reproduces the first voice signal, wherein the expanding unit uses the first voice signal acquired by the first acquiring unit as the voice signal acquired by the voice signal acquiring unit, the correcting unit uses the noise component included in the second voice signal acquired by the second acquiring unit as the noise component included in the voice signal acquired by the voice signal acquiring unit, and the output unit uses the first voice signal acquired by the first acquiring unit as the voice signal acquired by the voice signal acquiring unit, wherein the correcting unit corrects the power by the correction amount that is based on similarity of the noise components included in the first voice signal and the second voice signal, respectively, wherein the higher the similarity is, the greater the correction amount.

5. A signal processing method comprising:

acquiring a voice signal;

generating based on a narrowband component of the voice signal acquired at the acquiring, an expansion band component expanding the band of the voice signal;

correcting the power of the expansion band component by a correction amount determined based on a noise component included in the voice signal acquired at the acquiring; and outputting the voice signal of which the band has been expanded based on the expansion band component corrected at the correcting and based on the narrowband component of the voice signal acquired at the acquiring, wherein the voice signal is acquired by a voice signal acquiring method comprising the following steps:

a first acquiring step that acquires a first voice signal having a narrowed band; and a second acquiring step that acquires a second voice signal indicative of a voice near a reproducing device that reproduces the first voice signal, wherein the first voice signal acquired by the first acquiring step is used as the voice signal acquired by the voice signal acquiring method, the second voice signal acquired by the second acquiring step is used as the noise component included in the voice signal acquired by the voice signal acquiring method, and the first voice signal acquired by the first acquiring step is used as the voice signal acquired by the voice signal acquiring method, wherein the correcting includes correcting the power by the correction amount that is based on a ratio of the noise component included in the first voice signal and the noise component included in the second voice signal, wherein the higher the ratio is, the greater the correction amount.

6. A telephone apparatus comprising:

a receiving unit that receives a first voice signal by way of a network;

a first acquiring unit that acquires the first voice signal received by the receiving unit;

an expanding unit that generates based from a narrowband component of the first voice signal acquired by the first acquiring unit, an expansion band component expanding the band of the first voice signal;

a second acquiring unit that acquires a second voice signal indicative of a voice near a receiver that reproduces the first voice signal;

a correcting unit that corrects the power of the expansion band component by a correction amount determined based on a noise component included in the second voice signal acquired by the second acquiring unit;

an output unit that outputs to the receiver, the voice signal of which the band has been expanded based on the expansion band component corrected by the correcting unit and based on the narrowband component of the first voice signal; and a transmitting unit that transmits by way of the network the second voice signal acquired by the second acquiring unit, wherein the expanding unit uses the first voice signal acquired by the first acquiring unit as the voice signal acquired by the receiving unit, the correcting unit uses the noise component included in the second voice signal acquired by the second acquiring unit as the noise component included in the voice signal acquired by the receiving unit, and the output unit uses the first voice signal acquired by the first acquiring unit as the voice signal acquired by the receiving unit, wherein the correcting unit corrects the power by the correction amount that is based on a ratio of the noise component included in the first voice signal and the noise component included in the second voice signal, wherein the higher the ratio is, the greater the correction amount.

7. A voice processing apparatus, comprising:

a voice signal acquiring unit that acquires a voice signal converted to plural frequency bands from an input signal having a narrowed band;

an expanding unit that generates based on a narrowband component of the voice signal acquired by the voice signal acquiring unit, an expansion band component expanding the band of the voice signal;

a correcting unit that corrects the power of the expansion band component by a correction amount determined based on a noise component included in the voice signal acquired by the voice signal acquiring unit; and an output unit that outputs the voice signal of which the band has been expanded based on the expansion band component corrected by the correcting unit and based on the narrowband component of the voice signal acquired by the voice signal acquiring unit, wherein the voice signal acquiring unit comprises:

a first acquiring unit that acquires a first voice signal having a narrowed band; and a second acquiring unit that acquires a second voice signal indicative of a voice near a reproducing device that reproduces the first voice signal, wherein the expanding unit uses the first voice signal acquired by the first acquiring unit as the voice signal acquired by the voice signal acquiring unit, the correcting unit uses the noise component included in the second voice signal acquired by the second acquiring unit as the noise component included in the voice signal acquired by the voice signal acquiring unit, and the output unit uses the first voice signal acquired by the first acquiring unit as the voice signal acquired by the voice signal acquiring unit, wherein the correcting unit corrects the power by the correction amount that is based on a ratio of a voice component included in the first voice signal acquired by the first acquiring unit and the noise component, wherein the higher the ratio is, the smaller the correction amount.

* * * * *